US011786901B2

(12) United States Patent
Shanmugavelayudam et al.

(10) Patent No.: US 11,786,901 B2
(45) Date of Patent: Oct. 17, 2023

(54) ON-DEMAND THERMOREGULATION ELEMENT OR SYSTEM FOR STORAGE AND TRANSPORT OF TEMPERATURE SENSITIVE MATERIALS

(71) Applicant: MaxQ Research LLC, Stillwater, OK (US)

(72) Inventors: Saravan Kumar Shanmugavelayudam, Stillwater, OK (US); Arif Rahman, Stillwater, OK (US); Tyler Rapp, Stillwater, OK (US); Shoaib Shaikh, Stillwater, OK (US); Balaji Jayakumar, Stillwater, OK (US)

(73) Assignee: MaxQ Research LLC, Stillwater, OK (US)

( * ) Notice: Subject to any disclaimer, the term of this patent is extended or adjusted under 35 U.S.C. 154(b) by 363 days.

(21) Appl. No.: 16/896,896

(22) Filed: Jun. 9, 2020

(65) Prior Publication Data

US 2021/0379579 A1 Dec. 9, 2021

(51) Int. Cl.

| | |
|---|---|
| ***B01L 3/00*** | (2006.01) |
| ***B65D 81/38*** | (2006.01) |
| ***B65D 81/18*** | (2006.01) |
| ***A61J 1/16*** | (2023.01) |
| ***F24V 30/00*** | (2018.01) |

(52) U.S. Cl.
CPC ..... *B01L 3/508* (2013.01); *A61J 1/165* (2013.01); *B65D 81/18* (2013.01);
(Continued)

(58) Field of Classification Search
CPC ..... B01L 3/508; B01L 2200/12; B01L 2200/185; B01L 2300/18;
(Continued)

(56) References Cited

U.S. PATENT DOCUMENTS 2,042,103 A * 5/1936 Hyde, Jr. ..... E21B 36/008 126/263.05
3,653,372 A * 4/1972 Douglas ..... A47J 36/28 126/262

(Continued)

FOREIGN PATENT DOCUMENTS

CH 703828 A2 * 3/2012 ..... B65D 75/5883
EP 1154938 B1 9/2002

(Continued)

*Primary Examiner* — Emmanuel E Duke
(74) *Attorney, Agent, or Firm* — Michael S. Young IP Law LLC; Michael S. Young

(57) ABSTRACT

A container may include a storage volume configured to store a payload. A thermal insulation layer may surround the storage volume. A thermoregulation layer may surround the thermal insulation layer. There may be activation of a chemical reaction in the thermoregulation layer. The thermal insulation layer may have R-value per inch configured to expose the payload to a desired temperature to ensure viability of the payload and dampen a temperature spike of the chemical reaction. A system of containers may include a system storage volume with N containers in the system storage volume, wherein N is a whole number of 2 or more. A method of making an insulated container may include preparing an outer skin barrier layer, stacking a thermoregulation layer on the outer skin barrier layer, stacking a thermal insulation layer on the thermoregulation layer, and stacking an inner skin barrier layer on the thermal insulation layer.

18 Claims, 16 Drawing Sheets

Table 1. Blood Product Transport and Storage Requirements

| Blood Product | Purpose | Temperature | Duration | Other |
|---|---|---|---|---|
| Whole blood, red packed red cell | For transport to another center (stage 2, 4) | 4 °C to 10 °C | Depends on specified duration of the operation | Qualified container having sufficient cooling materials |
| Whole blood and packed red cell | For storage in blood center (stage 3, 5) | 4 °C to 6 °C | 35 days | Blood bank refrigerator |
| Platelet concentrates | For transportation to another center (stage 4) | 20 °C to 24 °C | 24 hours (maximum, some without agitation) | Qualified container having sufficient temperature stabilization materials |
| Platelet concentrates | For storage in blood center (stages 3, 5) | 20 °C to 24 °C | 5 or 7 days | Platelet incubator with agitator |
| Fresh frozen plasma | For storage in blood center (stages 3, 5) | Frozen state (below −18 °C) | 12 months from collection | Plasma freezer |
| Fresh frozen plasma | For transport to another center (stage 4) | Frozen state | Transportation with maintained in frozen state | Qualified container having sufficient cooling materials |
| Packed red cells, thawed plasma | Blood components ready for transfusion (stage 6) | 4 °C to 6 °C | Depends on specified storage duration of the cooler | Receptive coolers |

Sources: AABB, WHO

(52) U.S. Cl.
CPC ..... *B65D 81/3888* (2013.01); *F24V 30/00* (2018.05); *B01L 2200/12* (2013.01); *B01L 2300/18* (2013.01)

(58) Field of Classification Search
CPC ..... B01L 2300/0858; B01L 2300/1877; B01L 2300/1883; B01L 2300/1894; B01L 700/00; B01L 700/04; A61J 1/165; A61J 1/10; A61J 1/18; A61J 2200/42; A61J 2200/44; B65D 81/18; B65D 81/3888; B65D 33/04; B65D 79/02; B65D 81/3484; B65D 81/389; F24V 30/00
See application file for complete search history.

(56) References Cited

U.S. PATENT DOCUMENTS 4,095,583 A * 6/1978 Petersen ..... A61F 7/03 44/252
4,809,673 A * 3/1989 Charvin ..... A47J 36/28 126/263.08
7,854,897 B2 12/2010 Tanaami et al.
8,349,552 B2 1/2013 Haarmann et al.
9,896,389 B2 * 2/2018 Campbell ..... C06D 5/10
10,278,284 B2 * 4/2019 Campbell ..... B29C 35/0272
10,309,692 B2 * 6/2019 Campbell ..... H01L 23/3737
10,328,535 B2 * 6/2019 Campbell ..... B23K 35/365
2007/0028642 A1 2/2007 Glade et al.
2008/0271476 A1 11/2008 Langguth
2014/0243940 A1 * 8/2014 Schuller ..... A61F 7/034 607/110

FOREIGN PATENT DOCUMENTS

JP 06174350 A * 6/1994
JP H06174350 A * 6/1994
WO 1982002483 A1 8/1982
WO 2003002425 A1 1/2003
WO 2017051050 A1 3/2017

* cited by examiner

Table 1: Blood Product Transport and Storage Requirements

| Blood Product | Condition | Temperature Range | Transport/ Storage Time | Transport/ Storage Equipment |
|---|---|---|---|---|
| **Whole blood and packed red cell** | For transport to another center (steps 2, 4) | +1 °C to +10 °C | Depends on qualified duration of the container | Qualified container having sufficient cooling materials |
| **Whole blood and packed red cell** | For storage in blood center (steps 3, 5) | +1 °C to +6 °C | 35 days | Blood bank / Hospital refrigerator |
| **Platelet concentrates** | For transportation to another center (step 4) | +20 °C to +24 °C | 24 hours (maximum time without agitation) | Qualified container having sufficient temperature stabilization materials |
| **Platelet concentrates** | For storage in blood center (steps 3, 5) | +20 °C to +24 °C | 5 to 7 days | Platelet incubator with agitator |
| **Fresh frozen plasma** | For storage in blood center (steps 3, 5) | Frozen state (below −18 °C) | 12 months from collection | Plasma freezer |
| **Fresh frozen plasma** | For transport to another center (step 4) | Frozen state | Transported until maintained in frozen state | Qualified container having sufficient cooling materials |
| **Packed red cells, thawed plasma** | Blood components issued for transfusion (step 6) | +1 °C to +6 °C | Depends on qualified storage duration of the cooler | Portable coolers |

Sources: AABB, WHO

FIG. 1

ON-DEMAND THERMOREGULATION ELEMENT OR SYSTEM FOR STORAGE AND TRANSPORT OF TEMPERATURE SENSITIVE MATERIALS

SUMMARY

One general aspect includes a container may include a storage volume configured to store a payload. The container may also include a thermal insulation layer surrounding the storage volume; and a thermoregulation layer surrounding the thermal insulation layer, where activation of a chemical reaction in the thermoregulation layer produces an endothermic reaction or an exothermic reaction, the thermal insulation layer has R-value per inch configured to expose the payload to a desired temperature to ensure viability of the payload and dampen a temperature spike so the payload is not damaged from the activation of the chemical reaction.

Implementations may include one or more of the following features. The container where the payload includes a temperature sensitive biologic material that requires the desired temperature. The activation of the chemical reaction between the first chemical reactant and the second chemical reactant is configured to produce the endothermic reaction or the exothermic reaction. Breach of the divider causes the activation of the chemical reaction. The outer skin barrier layer and the inner skin barrier layer are coupled to encapsulate the thermoregulation layer and the thermal insulation layer in a thermoregulation volume, and the inner skin barrier layer lines the storage volume. The thermoregulation layer is characterized as a first thermoregulation layer, may include: a portal configured for an end user to remove the first thermoregulation layer from the thermoregulation volume and insert a second thermoregulation layer into the thermoregulation volume. The portal is the outer skin barrier layer, in the inner skin barrier layer, or between the outer skin barrier layer and the inner skin barrier layer, or some combination of in the outer skin barrier layer, in the inner skin barrier layer, and between the outer skin barrier layer and the inner skin barrier layer. The thermal insulation layer is characterized as an internal thermal insulation layer, may include: an external thermal insulation layer between the outer skin barrier layer and the thermoregulation layer, where the external thermal insulation layer is configured to protect an end user from the chemical reaction in the thermoregulation layer. The container may include: a sealing member in an open configuration configured so that the payload may be placed in the storage volume; and a fastener configured to fasten the sealing member in a closed configuration to seal the payload in the storage volume.

One general aspect includes a system of containers may also include a system storage volume; N containers in the system storage volume, where N is a whole number of 2 or more, and each of the N containers includes: a storage volume configured to contain a payload; a thermoregulation layer surrounding the storage volume in the N containers, where activation of a chemical reaction is configured to produce an endothermic reaction or an exothermic reaction; and a thermal insulation layer surrounding the storage volume of the n containers, where the thermal insulation layer is configured to expose the payload to a desired temperature and dampen a temperature spike so the payload is not damaged from the activation of the chemical reaction.

Implementations may include one or more of the following features. A system of containers where the payload includes a temperature sensitive biologic material that requires the desired temperature. Each of the N containers are of substantially same size and shape. At least one of the N containers is of substantially different size and shape from other n containers. At least one of the N containers is configured to be removed from the system storage volume while others of the N containers remain in the system storage volume without damage to the N containers. The thermoregulation layer surrounding the storage volume in the N containers, may include: a first chemical reactant in at least one of the thermoregulation layer surrounding the storage volume in the N containers; and a second chemical reactant in the at least one of the thermoregulation layer surrounding the storage volume in the N containers, where the activation of the chemical reaction between the first chemical reactant and the second chemical reactant is configured to produce the endothermic reaction or the exothermic reaction. The system thermoregulation layer is configured for a system chemical reaction that is predetermined, and the system thermal insulation layer is configured for the payload to experience the desired temperature and to dampen the temperature spike from the system chemical reaction.

One general aspect includes a method of making an insulated container. The method of making may also include preparing an outer skin barrier layer; stacking a thermoregulation layer on the outer skin barrier layer, where the thermoregulation layer is configured for a chemical reaction for a desired temperature that is predetermined; stacking a thermal insulation layer on the thermoregulation layer, where the thermal insulation layer is configured so that a payload only experiences the desired temperature from the chemical reaction; and stacking an inner skin barrier layer on the thermal insulation layer.

Implementations may include one or more of the following features. The method of making the insulated container may include: encapsulating the thermoregulation layer and the thermal insulation layer between the outer skin barrier layer and the inner skin barrier layer; and coupling the outer skin barrier layer to the inner skin barrier layer. The storage volume is configured to store the payload; coupling a first edge of the outer skin barrier layer; and coupling a second edge of the outer skin barrier layer. The thermal insulation layer is characterized as an internal thermal insulation layer, may include: stacking an external thermal insulation layer on the outer skin barrier layer and under the thermoregulation layer, where the external thermal insulation layer is configured to protect an end user from the chemical reaction.

BRIEF DESCRIPTION OF DRAWINGS

The following figures show some embodiments in accordance with the present disclosure.

FIG. 1 shows table of blood storage and transportation requirements as an example of temperature requirements for temperature sensitive materials.

DETAILED DESCRIPTION

Figure 2:
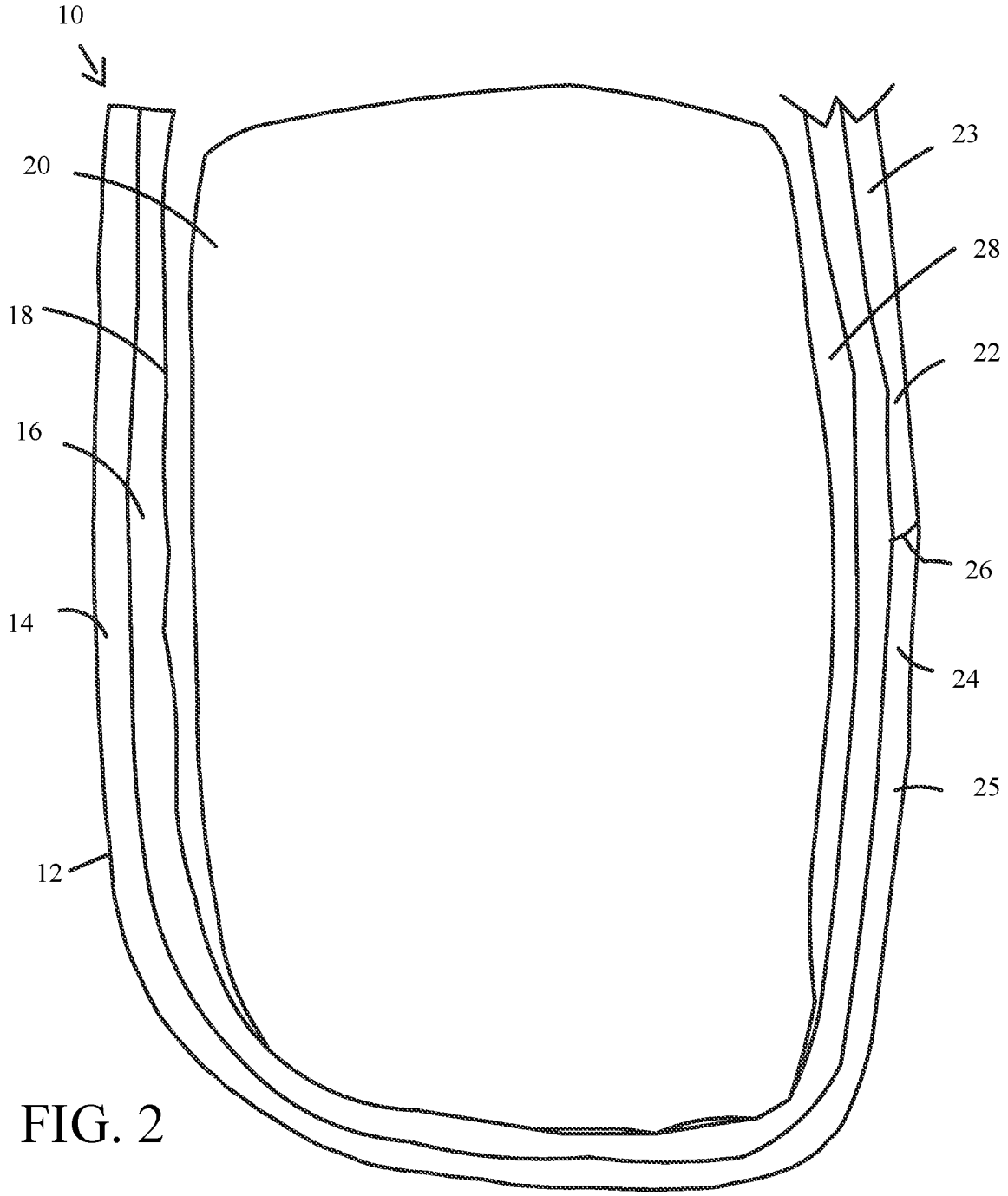
FIG. 2 shows cross sectional view of an on-demand thermoregulation container.

Temperature sensitive materials may be biologics, pharmaceuticals, chemicals, foods, or other items by way of example and not limitation. For example, there is a challenge of storing and transporting temperature sensitive materials extends into many industries including pharmacies, mail-in pharmacies, pharmaceutical manufacturers and distributors, diagnostic labs, etc. by way of example and not limitation. For instance, a patient's blood specimen collected in a clinic or specimen collection center may be then transported to a centralized testing lab for analysis. Often these specimens are packed inside disposable biohazard plastic bags and placed inside recreational or consumer grade coolers with wet ice for transport. The coolers are large, heavy, and do not offer adequate thermal protection to the specimens. This transport may result in the patient's blood specimen going outside the required temperature range which compromises the specimen integrity and the test outcomes from analysis of the specimen. The labs and hospitals charged with analyzing the specimen may have to recall the patient to collect a fresh sample.

In the case of retail-, mail-in-, direct-to-patient-, and specialty-pharmacy distribution, temperature sensitive drugs are traditionally packaged in Styrofoam® boxes with frozen water-based gel packs or wet ice even for short duration transports. (Styrofoam is a registered trademark of its owner, which is currently the Dow Chemical corporation.) One of the key challenges to proper handling and transport of temperature sensitive materials is that if the temperature sensitive drug comes in direct contact with the frozen gel pack or wet ice, then the temperature sensitive drug could freeze or crystalize, potentially damaging the drug and rendering the temperature sensitive drug unusable or ineffective.

In addition, with current developments in de-centralized distribution models and drone logistics, a majority of these transports are intra-city shipments and the transit duration is less than 8 hours. The Styrofoam® based package designs were originally developed for shipments that are over 18 hours (e.g., overnight) and less than 48 hours. When used in the less than 8-hour shipments or transports, these Styrofoam packages may be considered over-engineered and inefficient, bulkier, and heavier than packages that are designed specifically for 8 hours of transport. Also, the gel packs need to be conditioned/charged inside a sub-zero freezer to be frozen before each shipment. These inefficient, bulky, and heavy Styrofoam® packages along with the required conditioning/charging time increase storage, processing, handling, and shipping costs per unit of drug or other temperature sensitive material shipped.

Blood products, collected from donors, go through a complex blood supply chain before they are used or transfused into a patient. A blood product may be any substance prepared from blood, such as human blood. Blood products include, but may not be limited to, whole blood, blood components, and plasma derivatives. Blood components include, but may not be limited to, red blood cells, platelets, plasma, and cryoprecipitate. Plasma derivatives include, but may not be limited to, plasma proteins that include albumin, coagulation factor concentrates, and immunoglobulins.

At each step in the blood supply chain, precise temperatures must be maintained to ensure viability of the blood products. If the blood products are too cold or too warm, then the blood products may become unusable. Blood products from donors may be transported to facilities, such as but not limited to centralized manufacturing facilities, where the blood products may be tested for infectious diseases and processed also into other different blood products. The processed blood products may then be shipped to blood banks, such as found in hospitals and infusion centers, where the blood products are stored at precise temperatures inside refrigerators, freezers, controlled room temperature incubators, etc. When a patient requires a blood product, such as a transfusion, the blood bank may dispense a required amount of the blood products in a storage cooler to be placed near the patient, for example bedside. As shown in FIG. 1, according to the AABB (American Association of Blood Banks) and the World Health Organization (WHO), blood products must be maintained within a critical range of temperatures during a short timeframe to remain viable.

The modern blood supply chain may include at least seven (7) points of failure where any delays, miscommunications, or procedural issues can cause serious problems with the quality and usability of the blood product. The steps in the modern blood supply chain (200) typically include, but are not limited to:

(201) The donor gives blood.

(202) After donation, blood units and donor blood specimens are placed into temperature-controlled storage containers and transported to the blood bank which may be many miles away.

(203) At the blood bank, the blood is tested, processed, and stored according to precise specifications determined by the blood bank in compliance with corporate, state, national, international and/or association standards, such as the standards promulgated by the American Association of Blood Banks (AABB) in the United States.

(204) When ordered, blood products are again placed within temperature-controlled storage containers and transported to the hospital or other location where blood products are needed.

(205) When received by the hospital, the blood products are again stored according to precise specifications determined by the hospital in compliance with the relevant storage and handling standards.

(206) When ordered by the physician, blood products are packaged and delivered to the patient's bedside.

(207) Finally, the blood product is transfused into the patient as needed, over a period of time, during which time additional units of blood product may be stored next to the patient's bed while the patient receives a unit via transfusion. Each of these seven generalized steps represents a possible point of failure where any delays, miscommunications, or procedural issues can cause serious problems. Further, some units of blood or blood components may be returned to the blood bank, such as when the patient no longer requires the blood products. Fewer or more steps may be in the modern blood supply chain.

Often blood banks may issue, from inventory in storage, a single unit of blood product for transfusion to a particular patient on demand. These single units of blood products are handed out in containment bags (e.g., biohazard clear plastic bags) that offer no significant thermal protection to the blood product, and the bags are not temperature controlled storage, such as used for the inventory stored in the blood bank. In some cases, the units inside the biohazard bags may be sent to a patient room or procedural areas using a pneumatic tube transport system. When the unit of blood products, also known herein as a blood unit, is returned to the blood bank due to a change in condition of the patient such that the blood product is no longer required, the blood bank cannot return the unit of blood product back to the inventory in storage, because the blood product may be outside of the required temperature compliance. This inability to return the blood product to inventory for later use may result in significant wastage of the blood products from blood banks and may lead to shortages of blood products in inventory.

Blood products may represent an expensive and labor-intensive resource, accounting for approximately 1% of hospital expenditures. Yet the transportation and storage of blood products is often an inefficient and costly process. This inefficient and costly process may be due to the complexity of the blood product supply chain: the series of collection, refrigerated production, storage, and distribution activities; equipment required; and logistics required to maintain a desired temperature range that is predetermined.

For example, Red Blood Cell (RBC) product wastage in hospitals are reported to range anywhere from 0.1% to 6.7% of RBC product issued from the blood bank. In one study, approximately 87% of wasted RBC units were either single units of RBC that were out of storage in the blood bank for more than 30 minutes (e.g., single units of RBC dispensed but not administered).

Several different factors contribute to waste of the RBC product. Yet many of these factors can be improved, including:

Management of temperature-validated packaging containers,

Lack of awareness and training of staff ordering and handling RBC products,

Inconsistent interpretation of RBC temperature indicators, and

Need for accountability when ordering a blood product.

For at least these reasons, there may be a need for an efficient and economical container for on-demand preparing, packing, and transporting of temperature sensitive materials at precise temperatures. As shown in FIG. 2, an on-demand thermoregulation container 10, also known herein as an OT container 10, may include an outer skin barrier layer 12, a thermoregulation layer 14, a thermal insulation layer 16, and an inner skin barrier layer 18. The OT container 10 may be stored at an environmental temperature, such as the room temperature, in a blood bank or other facility where the OT container 10 may be used with a payload 20 that is a temperature sensitive material, such as a single unit of blood product.

The thermoregulation layer 14 may include a first chemical compartment 22 for a first chemical reactant 23 and a second chemical compartment 24 for a second chemical reactant 25 separated by a divider 26. Breach of the divider 26 between the first chemical reactant 23 and the second chemical reactant 25 could initiate a chemical reaction between the first chemical reactant 23 and the second chemical reactant 25. The divider 26 may be frangible such that the divider 26 can be breached by application of force from an end user using any suitable mechanical means, which can include application of force by a hand squeezing, pressing, kneading, etc. to the first chemical compartment 22, the second chemical compartment 24 or both. This on-demand chemical reaction may start absorbing (endothermic reaction) or releasing (exothermic reaction) heat energy "instantaneously" or "nearly instantaneously" inside the thermoregulation layer, such as on the order of within 5 seconds, 15 seconds, or 30 seconds of starting of the chemical reaction. The time for the chemical reaction to start absorbing or releasing heat energy is at least determined by the first chemical reactant 23 and the second chemical reactant 25 chemical properties, etc. The chemical reaction may be preselected to meet onset requirements to start absorbing or releasing heat energy. The chemical reaction may produce heat energy at a precise temperature, which may be selected to be at a required temperature for the payload or within a required temperature range for the payload to maintain viability according to some predetermined standard. See for example FIG. 1. The amount and rate of energy absorbed or released is proportional to the amount of the first chemical reactant 23 and the second chemical reactant 25 available in the thermoregulation layer 14. Unlike an electrically powered thermoregulation system, this on-demand thermoregulation would not need ongoing electrical energy input from the mains so that it is more portable, a battery that could corrode or become energy depleted during storage time, etc.

The thermoregulation layer 14 may comprise an endothermic or exothermic chemical reaction, wherein the active chemical reactants may be packaged in separate compartments. The first chemical compartment 22 and the second chemical compartment 24 interact with each other in the thermoregulation layer 14. There may be one or more of the first chemical compartment 22. There may be one or more of the second chemical compartment 24. There may be a different number of the first chemical compartment 22 and the second chemical compartment 24. The first chemical reactant 23 may be contained in the first chemical compartment 22. The second chemical reactant 25 may be contained in the second chemical compartment 24. The first chemical compartment 22 may be inside the second chemical compartment 24. The first chemical compartment 22 may be surrounded by the second chemical compartment 24. Alternatively, the first chemical compartment 22 may surround the second chemical compartment 24, and the second chemical compartment 24 may be inside the first chemical compartment 22.

As shown in a side view cross-section in FIG. 2, the thermal insulation layer 16 may be located between a storage volume 28 of the OT container 10 and the thermoregulation layer 14. In addition, the thermal insulation layer 16 may be located between the inner skin barrier layer 18 and the thermoregulation layer 14. Therefore, the thermal insulation layer 16 may be between the thermoregulation layer 14 and a payload 20 in the storage volume 28 of the OT container 10. This configuration of the thermal insulation layer 16 between the thermoregulation layer 14 and the payload 20 may prevent unintended thermal shock on the payload 20 from the chemical reaction produced by interaction of the first chemical reactant 23 and the second chemical reactant 25. For example, while the chemical reaction may be considered stable at a precise temperature or in a range of temperatures (also known herein as the temperature range) over the course of the chemical reaction between the first chemical reactant 23 and the second chemical reactant 25, the chemical reaction could momentarily decrease (endothermic reaction) or increase (exothermic reaction) a temperature of the thermoregulation layer 14 to a level that could be harmful to the payload 20. For example, the chemical reaction could momentarily drop the temperature of the thermoregulation layer 14 to subzero centigrade levels when an endothermic reaction is triggered. Such a drop in temperature could be harmful to the payload 20, such as a blood product unit. Similarly, this configuration of the thermal insulation layer 16 between the thermoregulation layer 14 and the storage volume 28 may prevent unintended temperature shock on the payload 20 from an endothermic or an exothermic reaction.

The term momentarily regarding the chemical reaction refers to the time between the start of the chemical reaction and steady state of the temperature produced by activation of the chemical reaction. For any the endothermic reactions or exothermic reactions, the decrease or drop (endothermic reaction) in temperature or the increase or rise (exothermic) in temperature will typically happen for a short period of the time, such as about 5 seconds to about 300 seconds or thereabouts, before the chemical reaction arrives at the steady state of the desired temperature or the desired temperature range that is experienced by the payload 20. The chemical reaction may be chosen by the manufacturer or end user to have a steady state temperature at the desired temperature or the desired temperature range that is experienced by the payload 20.

In a steady state, the value in question remains substantially the same over a given time period. In heat transfer problems, such as the chemical reaction, if there is specific rate of heat transfer through medium and if the specific rate of heat transfer remains constant over time during the chemical reaction, then the heat transfer is said to have a steady state. In steady state, there may be different temperatures in body at different locations but the temperature at any given location will remain constant. If the temperature at all locations is substantially the same, then the temperature is uniform.

One skilled in the art would understand that the disclosure provides a way to control a temperature of the thermoregulation layer 14 based on the chemical reaction and the time of the chemical reaction until exhaustion. On the other hand, the temperature experienced by the payload 20 is responsive to the temperature of the thermoregulation layer 14. The temperature experienced by the payload 20 is not directly controlled.

Furthermore, one skilled in the art will understand that the desired temperature or the desired temperature range that is experienced by the payload 20 may be different than the temperature experienced in the thermoregulation layer 14 from the chemical reaction. For example, as a general rule the desired temperature or the desired temperature range for the payload 20 will be between the ambient environmental temperature in which the payload 20 is located and the thermoregulation layer 14. By way of example and not limitation, the following examples are presented. The desired temperature range is about 1° C. to about 6° C. The ambient environmental temperature is 22°. One skilled in the art would understand that a temperature of 7° C. or higher of the thermoregulation layer 14 would not enable the temperature experienced by the payload 20 to be in the desired temperature range. On the other hand, one skilled in the art would understand that a temperature of 6° or lower of the thermoregulation layer 14 would enable the temperature experienced by the payload 20 to be in the desired temperature range, which would be dependent upon heat energy transfer properties of the thermal insulation layer 16. Similarly, for an exothermic reaction if the desired temperature range is about 30° C. to about 35° C., one would need a temperature of 30° C. or higher of the thermoregulation layer 14 would enable the temperature experienced by the payload to be in the desired temperature range.

In other words, the thermal insulation layer 16 may dampen a temperature change produced by the chemical reaction between the first chemical reactant 23 and the second chemical reactant 25, such that the payload 20 is not damaged, or rendered ineffective or useless by the chemical reaction. By way of example and not limitation, suppose the payload 20 needs to be maintained in the desired temperature range between 1° C. and 6° C., or between about 1° C. and about 6° C. Further suppose that the thermoregulation layer 14 can produce a chemical reaction in steady state to maintain a temperature of about 4° C. until the endothermic reaction is exhausted through depletion of the first chemical reactant 23 or the second chemical reactant 25 or both. When the chemical reaction is exhausted, the endothermic reaction ceases. The steady state temperature of the endothermic reaction is in the desired temperature range that is predetermined for the payload 20, so if the payload 20 was in direct contact with the thermoregulation layer 14, the payload 20 should be properly temperature controlled for the duration of the endothermic reaction. This situation would be much better than the typical situation in which wet ice or dry ice or a gel pack is in direct contact with the payload 20. Direct contact of the payload 20 with the ice or gel pack could freeze the payload 20, because the temperature of the ice or gel pack at contact could be lower than the desired temperature that is predetermined for the payload 20. Freezing the payload 20 could damage or render the payload 20 ineffective or useless.

However, before reaching the steady state, the temperature of the chemical reaction of an endothermic reaction could go to a lower temperature than the steady state temperature that is ultimately achieved. This lower temperature could damage or render ineffective or useless the payload 20 that is exposed to this lower temperature. Therefore, placing the thermal insulation layer 16 between the thermoregulation layer 14 and the payload 20 may help dampen or blunt the temperature response of the chemical reaction that is experienced by the payload 20. The initial temperature response of the chemical reaction might be considered a spike in the temperature of the thermoregulation layer 14. The thermal insulation layer 16 may be effective in preventing damage from the chemical reaction when the thermal insulation layer 16 permits the payload 20 to be exposed to the chemical reaction with a temperature in the desired temperature range or maintains the payload 20 in a usable fashion within the desired temperature range or at a precise temperature at the desired temperature that is predetermined until the endothermic reaction is exhausted.

In summary, activation of the chemical reaction may produce a spike in temperature that overshoots (i.e., too low of a temperature for an endothermic reaction or too high of the temperature for an exothermic reaction) the desired temperature at steady state. After the spike in temperature, also known as the temperature spike, then the temperature at steady state is achieved with ongoing consumption of the chemical reactants in the chemical reaction. The temperature at steady state may be chosen to achieve the desired temperature, such as 4° C. by way of example and not limitation, or the desired temperature range, such as 1° C. to 6° C. by way of example and not limitation, for the payload 20. When the chemical reactants are consumed such that the chemical reaction is exhausted, then the thermoregulation layer 14 no longer produces an endothermic reaction or an exothermic reaction. With the exhaustion of the chemical reaction, the temperature of the payload 20 would move towards the environmental temperature, such as the ambient environmental temperature.

As an alternative, the end user could initiate the chemical reaction and only insert the payload into the OT container 10 after the chemical reaction has reached steady state at a temperature that would not damage or render ineffective or useless the payload 20. However, such a process would rely upon the end user to be cognizant of when to place the payload 20 in the OT container 10, etc. It may be more practical to have a robust OT system such as the one disclosed for proper handling of the payload 20.

Of course, the proceeding discussion has been a practical example and not a limitation to the system. The payload 20 may be stored at the desired temperature or within the desired temperature range that is the range of desired temperatures that is predetermined. The environmental temperature may be the room temperature or some other temperature. A storage temperature of the payload may be at a temperature below, above, or at the environmental temperature. A transport temperature of the payload may be at, above, or below the storage temperature of the payload. An endothermic reaction or an exothermic reaction in relation to the environmental temperature, storage temperature, the payload temperature, etc. by way of example and not limitation may be within the scope of the disclosure.

One could even envision utilization of a series of OT containers 10. For example, the payload 20 may be in a blood bank. The payload 20 could be placed into the OT container 10 with an endothermic reaction that is placed near a patient until utilization of the payload 20 is needed. Then, the payload 20 may be placed in the OT container 10 with an exothermic reaction to effectively warm the payload 20 before infusion of the payload 20 into the patient.

The outer skin barrier layer 12 and the inner skin barrier layer 18 layer may be constructed of any material. In some situations, the outer skin barrier layer 12 and the inner skin barrier layer 18 layer may be constructed out of a non-porous polymer film that may be relatively easy to sterilize and may offer low thermal conductivity, e.g., polyethylene, polyethylene terephthalate, polypropylene, aluminized polyethylene terephthalate (which is polyethylene terephthalate deposited with a thin layer, e.g., a few microns, of aluminum to reduce oxygen transmission rate), etc. by way of example and not limitation. The OT container 10 may be easy to clean because of the non-porous polymer material, for example. The OT container 10 may be easy to sterilize for use in clean rooms, operating rooms, or other sterile areas within a hospital or other facility when the non-porous polymer material is used for the outer skin barrier layer 12 and the inner skin barrier layer 18. The non-porous polymer film may create a surface that would enable an end user to wipe down the OT container 10 using sterilization wipes when needed. A storage volume 28 of the OT container 10 may be lined with the inner skin barrier layer 18, which may be made of the same or different material as the outer skin barrier layer 12. The outer skin barrier layer 12 or the inner skin barrier layer 18 or both may be composed of a non-porous polymer with an oxygen transmission rate of about 0.01 cc/100 $in^2$/24 hr to about 0.11 cc/100 $in^2$/24 hr. The non-porous polymer may limit permeation of oxygen, microbes, or both into the OT container 10.

The thermal insulation layer 16 may be constructed of any suitable insulation material. The thermal insulation layer 16 of the OT container 10 may be built with flexible, low thermal conductivity materials, such as but not limited to, polymeric foams, chemically inert fiber layers and air bubble layers. E.g. polyethylene foam, polyurethane foam, PET fiber batting, bubble wrap, etc. The thermal insulation layer 16 may have a minimum thickness of about 0.2 inches or less to a maximum thickness of about 4 inches or more. The thickness of the thermal insulation layer 16 is chosen to meet the performance requirements of the thermal insulation layer 16.

Thermal insulation material may be classification and insulation rating may be based on an R-value per inch of the thermal insulation material. This R-value is commonly referred to in scientific literature as the thermal resistance value. The following are some exemplary materials that may be used for the thermal insulation layer 16. Foam based insulation materials may have a rating of about R-2 to about R-10 per inch. Examples of foam expanded insulation materials include but are not limited to expanded polystyrene (R-3 per inch) and extruded polystyrene (R-5 per inch). Fiber based insulation materials may have a rating of about R-1 to R-4 per inch. An example of fiber based insulation material includes but is not limited to fiberglass batting (R-2.5 per inch). Vacuum based insulation materials may have a rating of about R-10 to about R-50 per inch. An example of vacuum based insulation material includes but is not limited to fumed silica vacuum insulation panel (R-40 per inch). Air cell or column based insulation materials may have a rating of about R-0.2 to about R-4. An example of air cell or column based insulation material includes but is not limited to bubble wrap (R-zero point 5 per inch). The insulation material and thickness of the thermal insulation layer 16 are chosen based on the relationship of the desired temperature or desired temperature range and the chemical reaction. Furthermore, the environmental temperature may be accounted for in choosing the insulation material and thickness of the thermal insulation layer 16.

Figure 3:
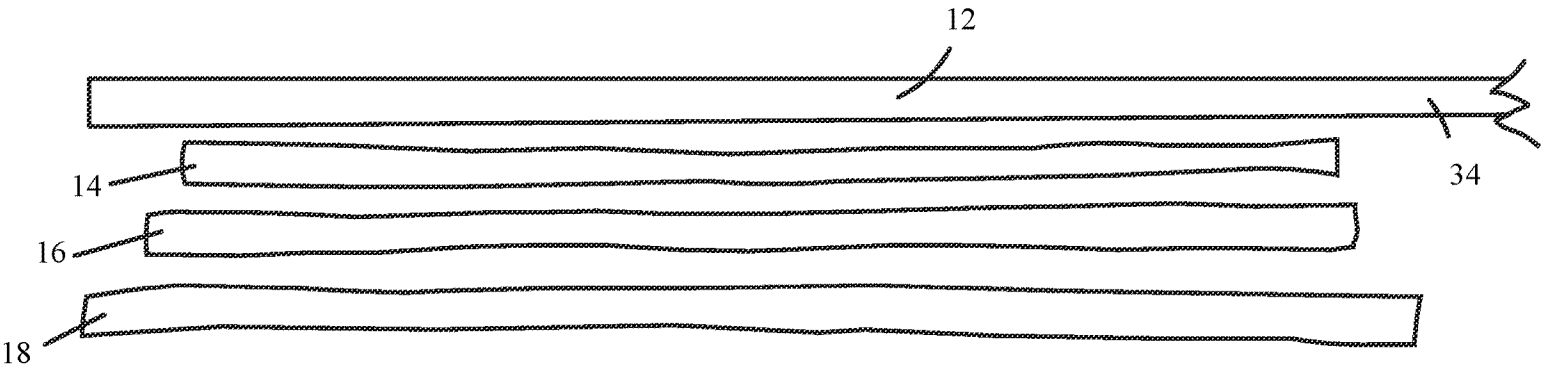
FIG. 3 shows a cross-section of a wall of an on-demand thermoregulation container.
Figure 4:
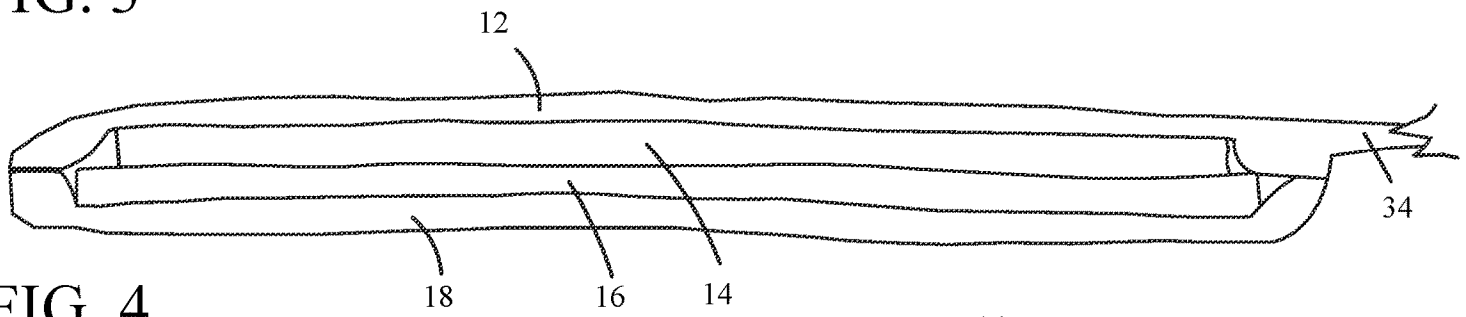
FIG. 4 shows a cross-section of an outer skin barrier layer, an inner skin barrier layer encapsulating thermal regulation layer and a thermal insulation layer.
Figure 5:
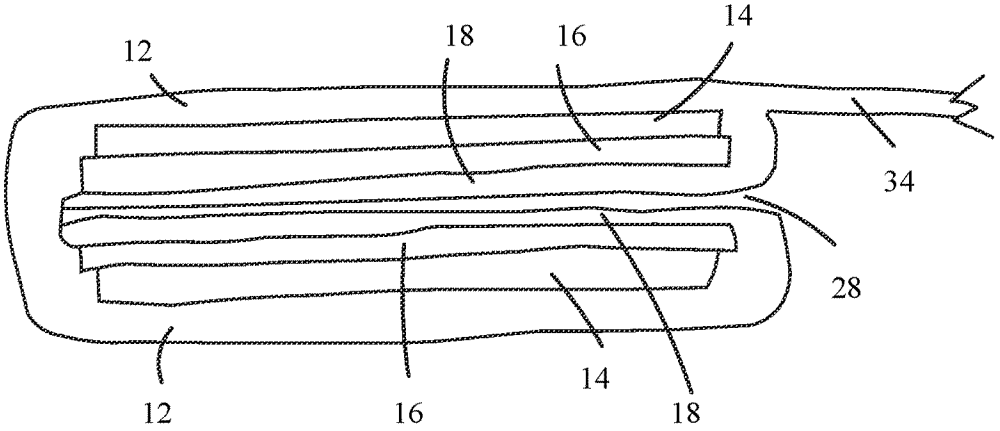
FIG. 5 shows a cross-section of a wall to form a storage volume.
Figure 6:
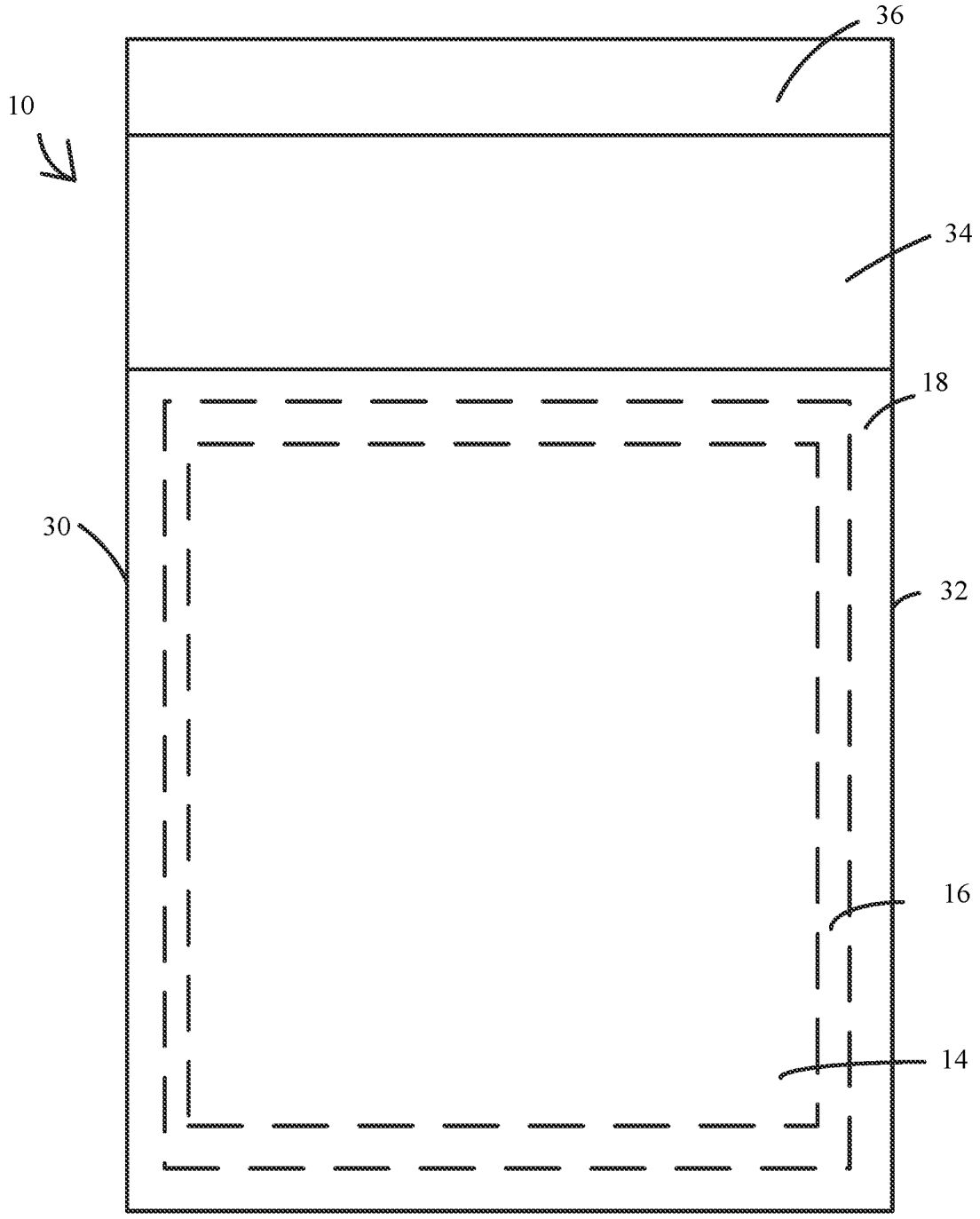
FIG. 6 shows a plan view of an on-demand energy regulation container.

There are several ways to manufacture the OT container 10 and the following manufacturing technique is by way of example and not limitation shown in plan view in FIG. 3 and side views in FIGS. 4, 5, and 6. As shown in FIGS. 3-6, the outer skin barrier layer 12 and the inner skin barrier layer 18 may be wider and longer compared to the thermoregulation layer 14 and the thermal insulation layer 16. The thermal insulation layer 16 may be wider and longer compared to the thermoregulation layer 14.

As shown in FIG. 3, the different layers may be arranged sequentially, namely, the outer skin barrier layer 12, the thermoregulation layer 14, the thermal insulation layer 16, and the inner skin barrier layer 18. The outer skin barrier layer 12 and the inner skin barrier layer 18 may be bonded together on all four sides using any suitable manufacturing technique, such as either one or combination of heat sealing, radiofrequency welding, ultrasonic welding, or adhesive bonding, by way of example and not limitation.

As shown in FIGS. 5 and 6, with the thermoregulation layer 14 and the thermal insulation layer 16 encapsulated between the outer skin barrier layer 12 and the inner skin barrier layer 18, the layers may then be folded in such a way that the inner skin barrier layer forms the storage volume 28. The outer skin barrier layer 12 may then be sealed along a first edge 30 and a second edge 32, in such a way that the inside of outer skin barrier layer 12 may be bonded to itself to render a 3-sided closed container.

The outer skin barrier layer 12 may be extended to be longer than the inner skin barrier layer 18 on a side to serve as a sealing member 34. The sealing member 34 may have a fastener 36, such as but not limited to adhesives, hook and loop fasteners, or other pouch sealing mechanisms. The outer skin barrier layer 12 may include the fastener 36 to enable the end user to seal or close the OT container 10 after the end user places the payload 20 to be stored or transported inside the storage volume 28 of the OT container 10. The fastener 36 may also serve as a chain of custody mark to the end user. The fastener 36 may be adhesive, hook and loop, etc. by way of example and not limitation. There may be one or more fastener 36 of the outer skin barrier layer 12 or the sealing member 34 or both.

Many alternative manufacturing techniques are contemplated, such as the inner skin barrier layer 18 may be extended to be longer than the outer skin barrier layer 12 to serve as the sealing member 34. Or both the outer skin barrier layer 12 and the inner skin barrier layer 18 may be extended to serve as the sealing member 34. Furthermore, the thermoregulation layer 14 and the thermal insulation layer 16 may extend into some or all the sealing member 34 as needed to provide temperature regulation around the storage volume 28. In addition, the outer skin barrier layer 12 or the inner skin barrier layer 18 or both skin barrier layers may also contain a heat sealable polymer layer or coating on one or more sides to help with the fabrication process.

The storage volume 28 may be considered to have an open configuration when the fastener 36 with unfastened. In the open configuration, the end user may be able to place the payload 20 in the storage volume 28. The storage volume 28 may be considered to have a closed configuration when the fastener 36 is fastened. The sealing member 34 may seal, or close, the storage volume 28 when the fastener 36 is closed. In the closed configuration, the end user may not be able to place the payload in the storage volume 28.

Figure 7A:
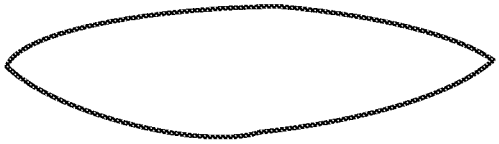
FIG. 7A-G shows an exemplary, but not limiting, cross sectional shapes of an on-demand energy regulation container.
Figure 7B:
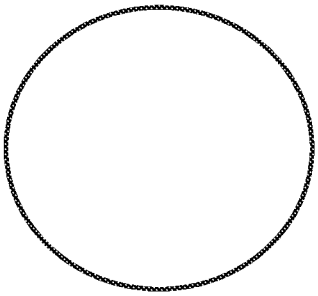
Figure 7C:
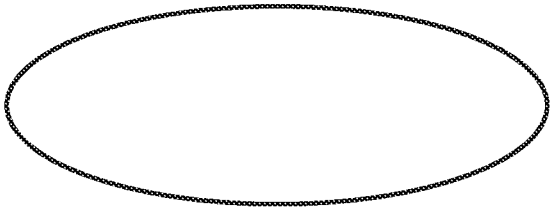
Figure 7D:
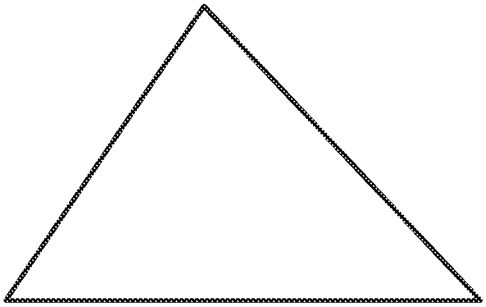
Figure 7E:
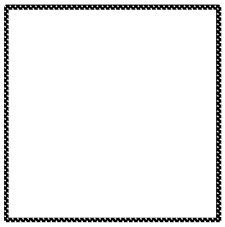
Figure 7F:
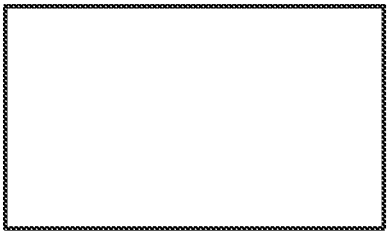
Figure 7G:
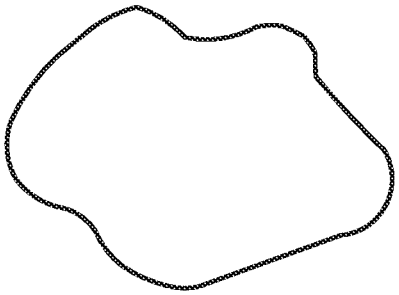

So far, the OT container 10 has been shown in what might be considered to be a pouch but other shapes are contemplated as shown in the following cross-sections. FIG. 7A shows an almond or eye shape with curvilinear surfaces. FIG. 7B shows a spherical shape with a curvilinear surface. FIG. 7C shows an oval shape with a curvilinear surface. FIG. 7D shows a triangular shape with linear surfaces. FIG. 7E shows a square shape with linear surfaces. FIG. 7F shows a rectangular shape with linear surfaces. FIG. 7G shows an irregular shape with curvilinear surfaces. The OT container 10 may have any size, shape, and configuration as needed. The OT container 10 may have a size, a shape, or a configuration selected to have a predetermined size, shape, or configuration of the storage volume 28 so that the inner skin barrier layer 18 may be in contact or close contact with the payload 20.

Opaque means blocking passage of radiant energy and especially light. An opaque layer would exhibit opacity. Transparent means having the property of transmitting light without appreciable scattering so that objects lying behind are seen clearly. A transparent layer would transmit light without appreciable scattering so that objects behind the layer are seen clearly. A transparent layer would exhibit transparency. Translucent means permitting the passage of light. A translucent layer would permit the passage of light. A translucent layer would exhibit translucency.

Figure 8:
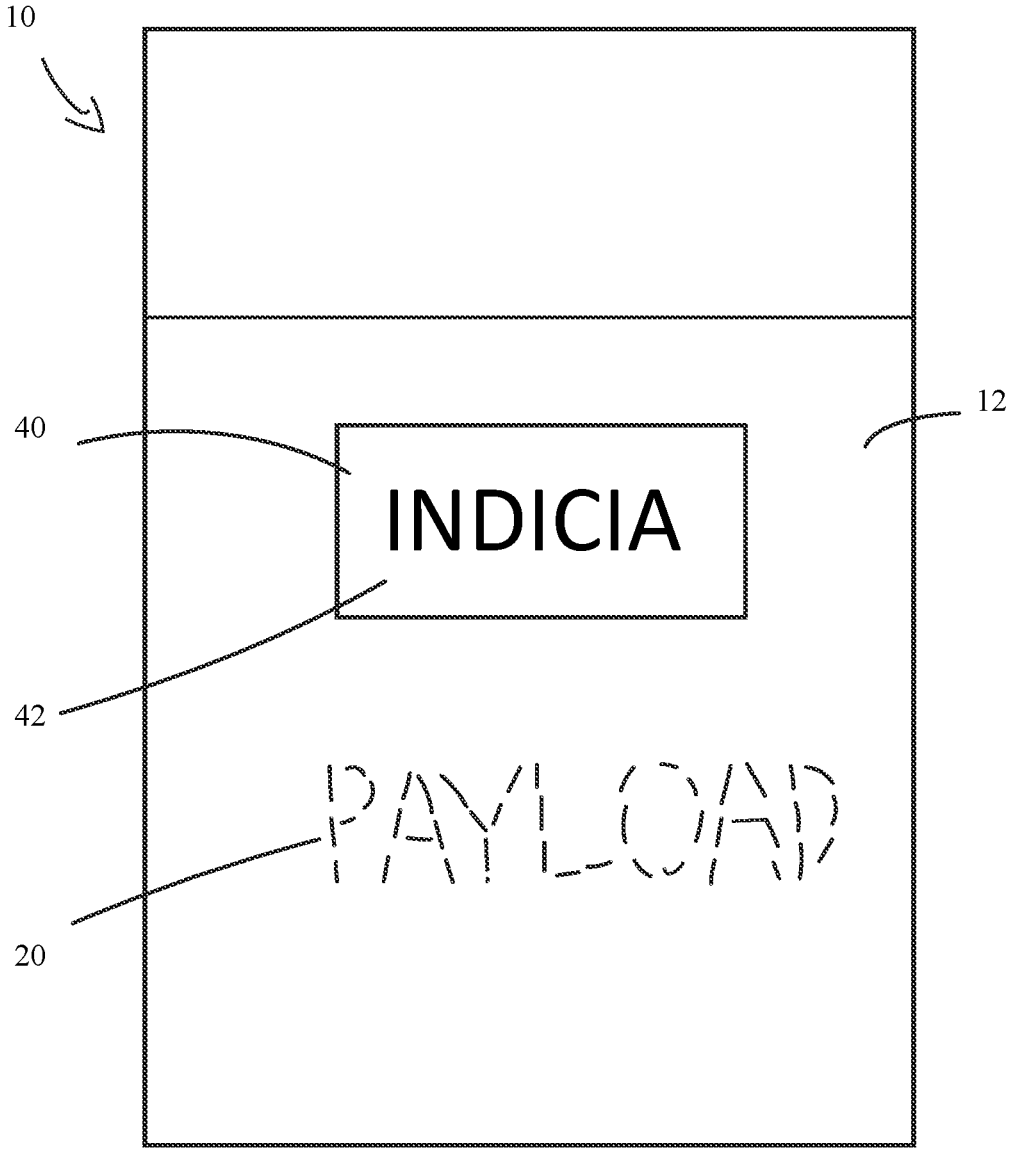
FIG. 8 shows a plan view of an on-demand energy regulation container with a window that is transparent.

As shown in FIG. 8, the outer skin barrier layer 12 could be opaque such that the payload 20 would not be visible to the end user of the OT container 10.

Alternatively, the OT container 10 could have a window 40 in the outer skin barrier layer 12 that is transparent so that the end user could see an indicia 42 on an inner surface of the outer skin barrier layer 12 or in the thermoregulation layer 14. Alternatively, the OT container 10 could have the window 40 in the outer skin barrier layer 12 and the thermoregulation layer 14 that is transparent so the end user could see the indicia 42 on an inner surface of the thermoregulation layer 14 or in the thermal insulation layer 16. Alternatively, the OT container 10 could have the window 40 in the outer skin barrier layer 12, the thermoregulation layer 14, and the thermal insulation layer 16 that is transparent so the end user could see the indicia 42 on an inner surface of the thermal insulation layer 16 or in the inner skin barrier layer 18. Alternatively, the OT container 10 could have the window 40 in the outer skin barrier layer 12, the thermoregulation layer 14, the thermal insulation layer 16, and the inner skin barrier layer 18 that is transparent so the end user could see the indicia 42 on an inner surface of the inner skin barrier layer 18 or when present the payload 20. The inner surfaces are towards the storage volume 28 shown in other figures.

In addition to having the window 40 in the thermoregulation layer 14 and the thermal insulation layer 16, one could achieve a similar visual effect by manufacturing the thermoregulation layer 14 and the thermal insulation layer 16 without material or through removal of material that lines up with the window 40 in the outer skin barrier layer 12. However, such a configuration might act as a thermal bridge and let heat transfer occur from the environment to the storage volume 28. By making the window 40 that the end-user can see through, one could still benefit from thermal protection provided by the OT container 10.

For example, the OT container 10 could have the window 40 that allows the end-user to see at least a portion of the payload in the OT container 10 that is sealed. The layers could potentially be at least partially transparent in order to allow the end user to see at least a portion of the payload 20 without opening the seal. For example, a polymer film could be metallized to offer reflective thermal insulation properties with a small non-metallized clear window to allow the end user to see or visualize at least a portion of the payload 20 without opening the seal or sealing member 34. The thermoregulation layer 14 or the payload 20 may have an indicia 42 that could indicate the temperature of the thermoregulation layer 14 or the payload 20, for example. Other uses for the indicia 42 include identification of the payload, time and date stamp that the payload was placed into the OT container 10, physical integrity of the payload (e.g., detection of the payload 20 is broken, shock indicators), etc.

Figure 9:
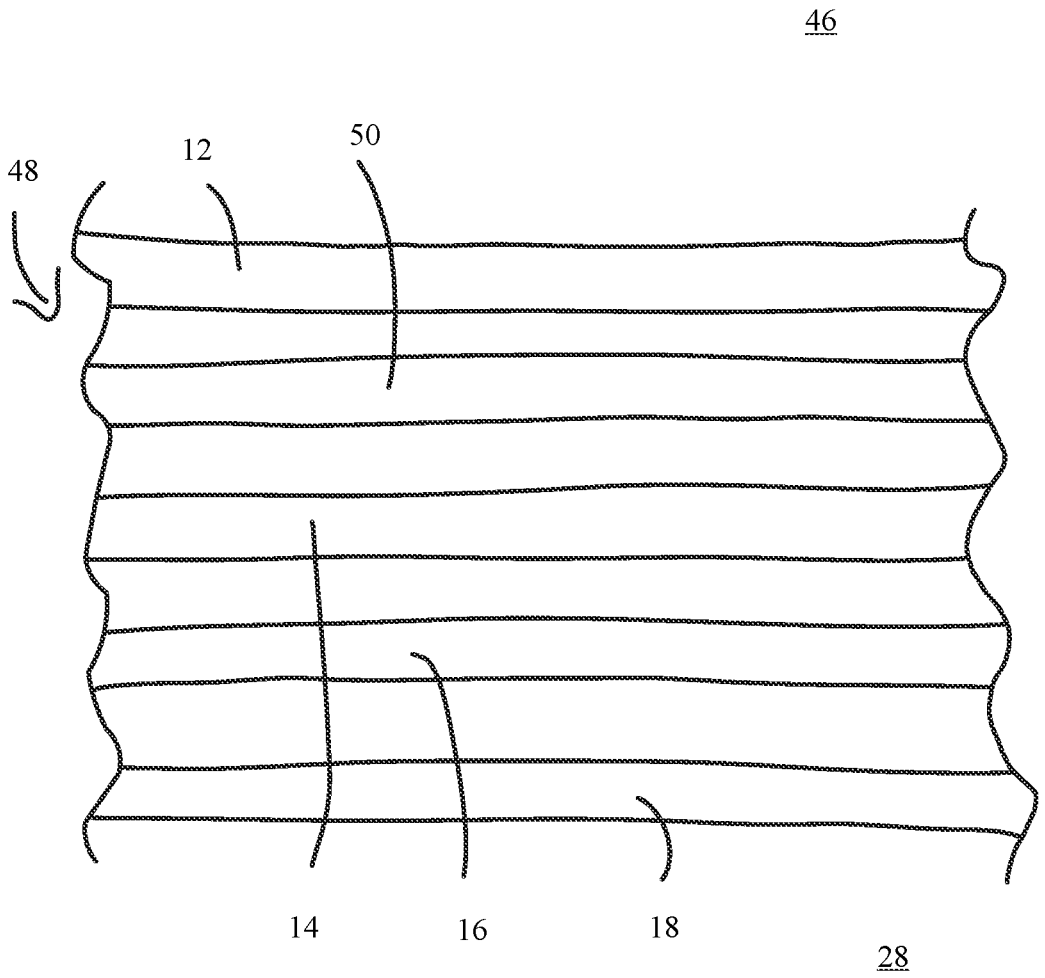
FIG. 9 shows a cross sectional view of a wall of an on-demand energy regulation container.

Of course, rather than just a window, the outer skin barrier layer 12 could be transparent over substantially its entire surface. Similarly, the other layers of the OT container 10 could be transparent over substantially their entire surfaces. As shown in FIG. 9, a wall 48 of the OT container 10 may include the outer skin barrier layer 12, the thermoregulation layer 14, the thermal insulation layer 16, and the inner skin barrier layer 18. While the thermal insulation layer 16 may be understood to reduce the chance of temperature or thermal shock on the payload 20, the end user may experience their own temperature or thermal shock from the thermoregulation layer 14 when the chemical reaction is happening. Therefore, another layer may be present, namely, an external thermal insulation layer 50. In this configuration, the thermal insulation layer 16 may be considered an internal thermal insulation layer. The wall 48 separates an environment 46 from the storage volume 28. The wall 48 may be present in all or part of the sealing member 34 or any other portion of the OT container 10.

Figure 10:
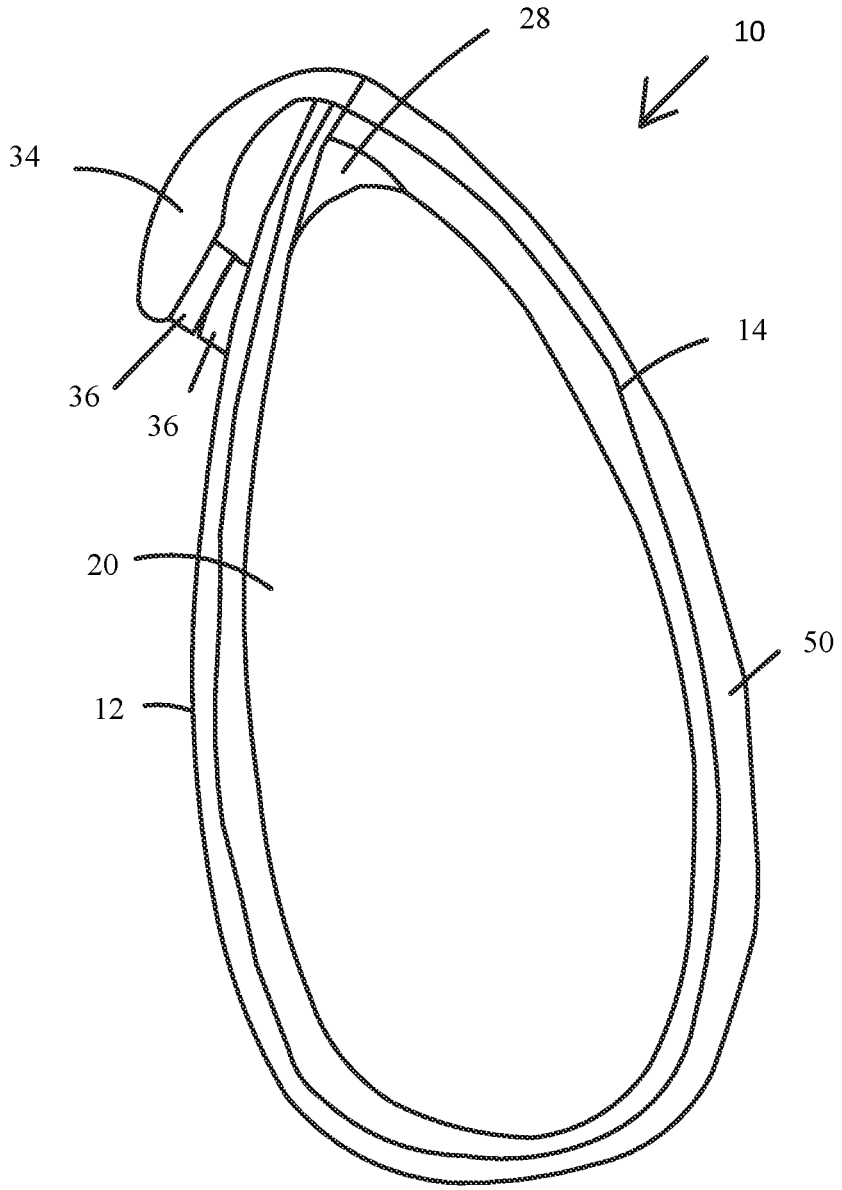
FIGS. 10-12 show cross-section views of on-demand energy regulation containers.
Figure 11:
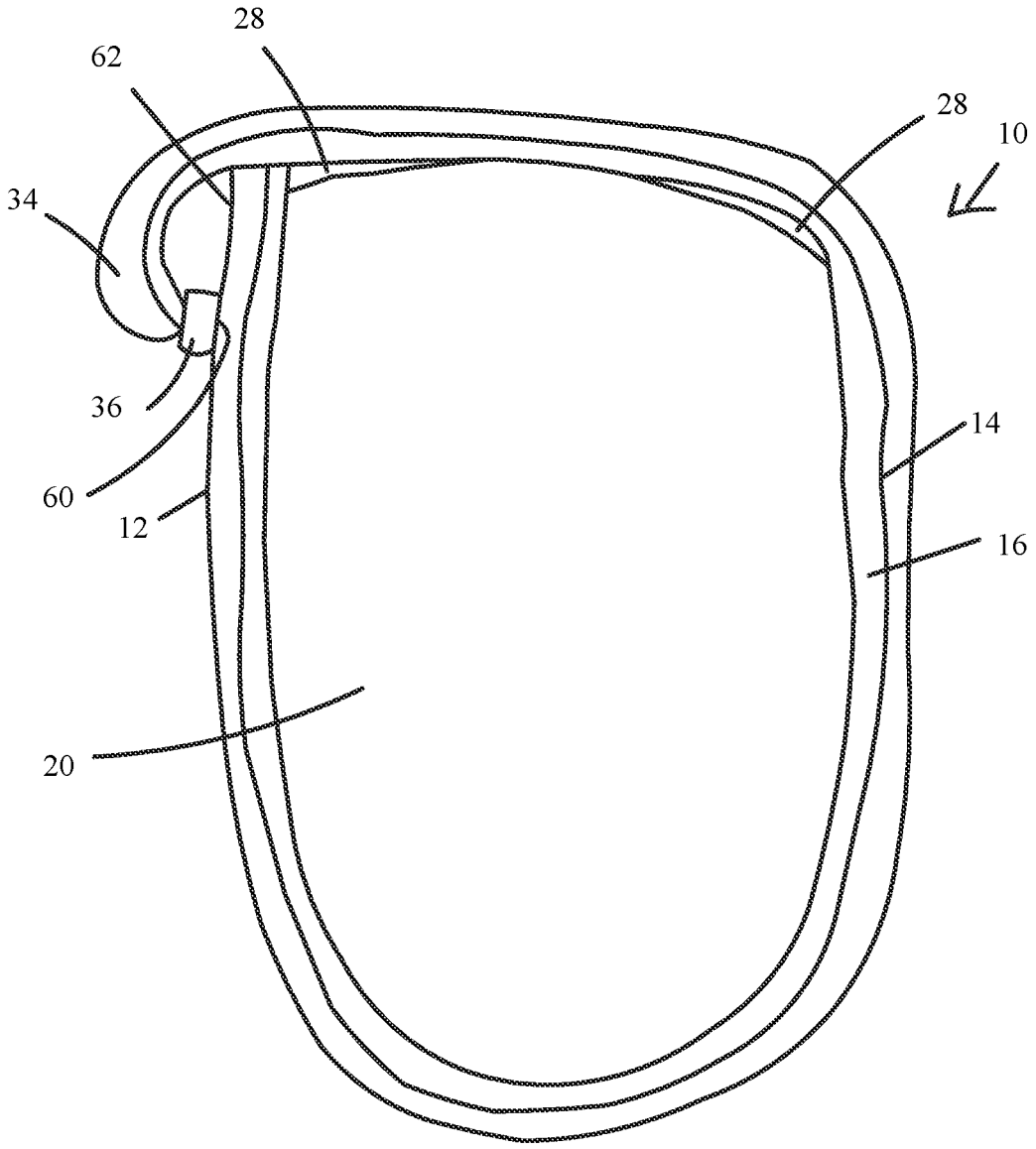
Figure 12:
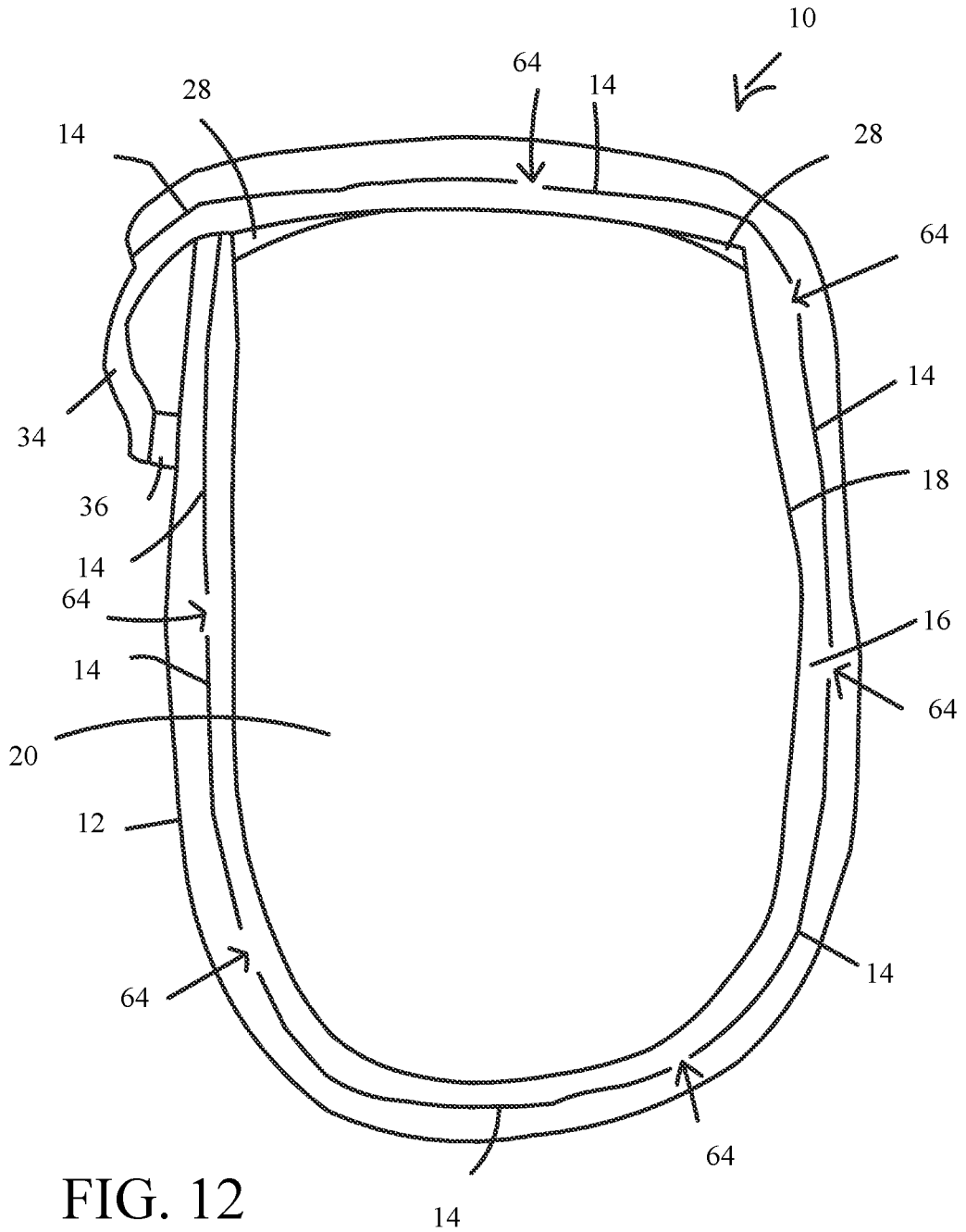

FIGS. 10-12 show the OT container 10 in cross-section side views. FIG. 10 shows the thermoregulation layer 14 may completely surround the storage volume 28. The payload 20 may be surrounded by the thermoregulation layer 14. Further, the thermoregulation layer 14 does not overlap upon itself. Rather, the sealing member 34 or flap extends from the wall 48. The fastener 36 from an inner surface of the sealing member 34 is coupled to the fastener 36 from an outer surface of the outer skin barrier layer 12.

FIG. 11 shows the thermoregulation layer 14 may again completely surround the storage volume 28. By completely surrounding the storage volume 28, the thermoregulation layer 14 may provide a uniform environment of temperature in the storage volume 28 for the payload 20. The uniform environment of temperature in the storage volume 28 may be cooling or heating of the payload 20 in relation to the environment outside the storage volume 28. By extending the thermoregulation layer 14 into the sealing member 34, the OT container 10 may provide a flexible volume in the storage volume 28. If the payload 20 is smaller, then the fastener 36 can be applied in a first position 60 on the outer skin barrier layer 12 to accommodate the smaller size. On the other hand, if the payload 20 is larger, and the fastener 36 can be applied in a second position 62 on the outer skin barrier layer 12 to accommodate the larger size.

FIG. 12 shows the thermoregulation layer 14 may be noncontinuous with a break 64 at predetermined distances. The thermoregulation layer 14 in this discontinuous configuration may be considered to be the equivalent of completely surrounding the storage volume 28 when the environment of temperature in the storage volume 28 is about the same on all surfaces of the inner skin barrier layer 18 surrounding the storage volume 28. The inner skin barrier layer 18 may be in contact with the payload 20 at various locations throughout the storage volume 28. Similarly, although not shown for the sake of clarity, the thermal insulation layer 16 between the thermoregulation layer 14 and the storage volume 28 may be discontinuous. As recalled from the discussion hereinabove, the thermal insulation layer 16 between the thermoregulation layer 14 and the storage volume 28 is intended to dampen any potential spike of increased or decreased temperature from the chemical reaction in the thermoregulation layer 14. Therefore, so long as the thermal insulation layer 16 achieves this effective goal of protecting the payload 20 from any spiking temperature from the chemical reaction that would otherwise damage the payload 20, the thermal insulation layer 16 may be considered to effectively surround the storage volume 28, even if the thermal insulation layer 16 is itself discontinuous.

Furthermore, FIG. 12 shows that the sealing member 34 may extend from the inner skin barrier layer 18. The fastener 36 may couple the sealing member 34 to the outer skin barrier layer 12. In addition, there may be some overlap of the thermoregulation layer 14 adjacent the sealing member 34. This overlap provides some flexibility in the sealing of the OT container 10. Of course, if the OT container 10 were more rigid such that the storage volume 28 always has substantially the same volume when used with the payload 20, then the flexibility in how to seal the OT container 10 may be less relevant.

The thermoregulation layer 14 may be filled with a salt+solution mix that actively absorbs heat, to cool the surrounding containment. In this specific example, urea is used as a salt, and water is used as a solvent. In other words, the urea may be the first chemical reactant 23 and the water may be the second chemical reactant 25, or the urea made be the second chemical reactant 25 and the water may be the first chemical reactant 23, in the various embodiments disclosed. Water is packed inside a separate flexible plastic pouch which can break easily when squeezed. An endothermic chemical reaction starts only when the water pouch is broken, and water comes directly in contact with urea. The endothermic chemical reaction absorbs a specific amount of heat over a predetermined amount of duration, depending on the amount of salt+water, thereby maintaining the temperature sensitive material inside the pouch at the desired temperature or within the desired temperature range. The thermal insulation layer 16 may be placed in between the thermoregulation layer 14 and the payload 20 inside the OT container 10 to ensure that the payload 20 stays within at the desired temperature or within a specific temperature range, also known herein as the desired temperature range.

A polymer film for the inner skin barrier layer 18 and the outer skin barrier layer 12 could be metallized to offer reflective thermal insulation properties, e.g., aluminized PET (such as Mylar®, which is a registered trademark of its owner). The reflective thermal insulation properties may add to temperature protection of the payload 20, via increased surface emissivity. The reflective thermal insulation properties layer may bounce off infrared thermal radiation by reducing the rate of heat entering the OT container. The OT container 10 may include a minimum thermal emissivity for the inner skin barrier layer 18 and the outer skin barrier layer 12 of about 0.23/100 μm. Emissivity is a measure of the ability of an object to emit infrared energy. Emitted energy indicates the temperature of the object. Emissivity can have a value from 0 (e.g., shiny mirror) to 1.0 (e.g., blackbody).

The OT container 10 may be integrated with the thermoregulation layer 14 and the thermal insulation layer 16 and when present the external thermal insulation layer 50 for storage and transport of temperature sensitive biologic materials such as blood, vaccines, pharmaceuticals, etc.

The outer skin barrier layer 12 or the inner skin barrier layer 18 or both may also contain a thermochromic layer or thermochromic print, which changes color when the OT container 10 is activated, meaning the chemical reaction is started, providing a visual confirmation to the end user. The OT container 10 may have a thermochromic indicator on the outer skin barrier layer 12. The thermochromic indicator may be a reversible indicator, which will change color when the temperature drops from the environmental temperature, such as room temperature, to a target temperature, such as 4° C., and will then change color as the temperature of the outer surface of the OT container 10 increases towards the environmental temperature. The thermochromic indicator may provide a visual confirmation to the end user that the chemical reaction of the OT container 10 has been activated. Furthermore, the thermochromic indicator may provide a simple visual indicator for the end user to know when the OT container 10 has gone below or above the target temperature. When the OT container 10 is activated, the OT container may function as a temperature-controlled storage containers.

The following uses of the OT container 10 are by way of example and not limitation.

Hospital blood bank: When requested one or more units of red blood cells (FDA mandated storage temperature: 1-6° C.), the hospital blood bank technician activates the OT container 10 by squeezing the pouch, places a single unit of the blood product inside the OT container 10, and seals the OT container 10 using the fastener 36. The OT container 10 with blood product can either be issued directly to the requesting health care provider, such as nurse or doctor, or sent in pneumatic tubes, or using a drone platform, or other established modalities for delivering the blood products. The OT container 10 may maintain the payload 20 of the blood unit in the desired, required, or mandated temperature range for a minimum of about 30 minutes or a minimum of about 60 minutes. For example, a minimum of about 30 minutes may be obtained with about 100 g of total salt (urea) plus water reaction mixture in 1:1 ratio with a maximum time limit of about 60 minutes. By combining predetermined amounts of the chemical reaction, the barrier layers and the thermal insulation layers, one could theoretically extend the time the OT container 10 may provide temperature protection for the payload up to 5 days or longer.

If the blood product is unused, the OT container 10 with the blood product may be returned to the blood bank within the maximum temperature protection duration that is proportional to the amount of chemical reactants. The blood bank technician can then check the elapsed duration since the blood product was issued, i.e., removed from storage in inventory, and the fastener 36, and then return the blood product to inventory if the fastener 36 meets requirements and the elapsed time since the blood product was issued does not exceed the maximum temperature protection duration. Of course, a safety factor may be incorporated into the maximum temperature protection duration, such that the chemical reaction may keep the payload 20 within the desired temperature range for 75 minutes, but the maximum temperature protection duration will be considered 60 minutes, by way of example and not limitation.

There could be a label on the OT container 10 where the end-user, such as the blood bank technician, will write down or have a printer print the payload details, patient information, and time issued. The technician will use the time stamp to determine whether to discard the blood unit returned to the blood bank or return unit to the storage and inventory. Flexible digital temperature displays, such as the e-ink screens, are another option to include on the label or on another label. By way of example and not limitation, Pervasive Displays' intelligent monochrome e-paper with integrated timing controller, SPI, and 140 dpi glare-free display, available from Digi-Key, as 1.54 Inch Aurora Mb E-Paper Display, could be used as the e-ink screen.

Diagnostic lab—specimen logistics: When a patient blood specimen is collected, it needs to be stored between 2-8° C. during transit to the diagnostic laboratory, or simply lab. The technician collecting the patient blood specimen can activate the OT container 10 by squeezing the OT container 10, then place the specimen tube inside the OT container 10 and seal the fastener 36. The OT container 10 with patient specimen may be sent to the lab using a courier service, or fleet vehicle, or using a drone platform, or other established modalities for delivering blood specimens to the lab. Upon receiving the pouch at the lab, the receiver can check the elapsed duration since the pouch was sealed with the fastener 36, and then the receiver or end user may remove the patient blood specimen for diagnostic testing.

Example 1

Endothermic reaction: Urea+Water in 1:1 wt % ratio. Urea salt along with water packaged in a separate plastic pouch are packed inside the temperature control element. The water pouch may be designed in such a way that its burst strength is low compared to burst strength of all other components of the OT container 10. So, when an end user squeezes the OT container 10, the water pouch bursts first and mixes with the urea salt. This reaction may start absorbing heat and drops the reaction temperature to about 4° C. This embodiment of the OT container 10 (i.e., barrier layer+thermoregulation layer+insulation layer) may work to maintain the payload 20 at required temperature ranges. In this embodiment of about 1 Urea to about 1 water weight percentage ratio, the payload 20 may be maintained between about 1° C. —about 6° C. However, the temperature spike may be about minus 1° C. with this chemical reaction.

Example 2

Exothermic reaction: Magnesium sulfate+water in 0.7:1 wt % ratio. Magnesium sulfate reacts with water to generate an exothermic reaction releasing about 91.38 kJ/kg of heat in the process. Initial temperature spike may be about 45° C., with steady state temperature of 35° C.

Example 3

Reaction between powder form: Hydrated Barium hydroxide in powder form can react with Ammonium Chloride in powder form (3:1 wt % ratio) to absorb heat and drop the reaction temperature to −25° C. with a steady state temperature of −20° C.

Example 4

Reaction between liquid form: Acetic Anhydride in liquid form can react with water in liquid form (1:1.75 wt % ratio) to release heat and increase initial reaction temperature to 78° C. followed by a steady state temperature of 70° C.

Any chemical reaction results in heat evolution (absorbed/released). At constant pressure, this evolution of heat is defined as change in enthalpy ($\Delta H$) or energy of the system. The chemical reactants' physical state could be either solid or liquid or gas. As an example, for any reaction with one solid phase reactant (solute) and one liquid phase reactant (solvent), the following happens:

1. Solute particles are separated from the solid reactant absorbing some energy ($\Delta H_1$)
2. Solvent particles in the liquid reactant move apart to make room for the solute to dissolve and absorb some energy ($\Delta H_2$)
3. Solute and Solvent particles are attracted to each other and release some energy ($\Delta H_3$)
4. For the final solution, the change in energy, $\Delta H$ is the sum of changes of energy due to the 3 events described above. $\Delta H=\Delta H_1+\Delta H_2+\Delta H_3$ Considering the sign of energy absorbed as negative (−) (i. e. $\Delta H_1$, $\Delta H_2$ as negative) and the sign of energy released as positive (+) (i. e. $\Delta H_3$ as positive). If the sum of energy absorbed for a reaction is larger than the energy released (i. e. $\Delta H_1+\Delta H_2>\Delta H_3$) then the reaction is endothermic ($\Delta H$='-'). Similarly, when the sum of energy absorbed for a reaction is smaller than the energy released ($\Delta H_1+\Delta H_2<\Delta H_3$) it is exothermic ($\Delta H$='+'). Some of the examples of endothermic reactions are ammonium nitrate dissolution in water, and ammonium chloride dissolution in water. Similar exothermic reactions are sodium hydroxide dissolution in water, and magnesium sulfate dissolution in water.

In addition to the chemical reaction, an active temperature control element, such as the thermoregulation layer 14, could potentially contain a phase change material with a phase transition temperature around the reaction temperature to act as a temperature buffering or energy storage mechanism. Once the reaction reaches the phase transition temperature, the phase change material may start changing phase with absorbing and storing the excess energy from reaction as latent thermal energy. The stored energy may be slowly released extending protection of the temperature sensitive material, such as the payload 20, inside the OT container 10 even after the chemical reaction is complete, which means that the chemical reaction no longer has the ability to absorb or release heat energy. The phase change material may also protect the temperature sensitive material from temperature shock if the reaction kinetics change due to external circumstances. For example, if someone accidently places the OT container 10 inside a colder ambient environment (e.g., 10-15° C. below room temperature), then the reaction temperature could quench and the reaction would go to sub-zero levels. The phase change material may in theory act as a buffer and absorb the thermal shock, thereby protecting the payload 20.

The phase change material could potentially be mixed into the chemical reaction in liquid form (e.g., Tetradecane, 1-Dodecanol, etc.) or dispersed in powder form (e.g., liquid form phase change material encapsulated in melamine formaldehyde, urea formaldehyde, silica, zinc oxide, etc.) or deployed as a flexible gel layer (e.g., tetradecane encapsulated in gelatin matrix, sodium polyacrylate mixed in water, etc.) adjacent to the active temperature control element.

In one embodiment, the present disclosure could be rendered as a flexible active temperature control pouch (i.e., OT container 10) for storage and transport of temperature sensitive biological materials, such as blood products, diagnostic specimens, etc., at required temperatures. A biologic drug (also known as biologics or biological material) is produced from living organisms or contain components of living organisms. Biologic drugs may include a variety of products produced from human, animal, or microorganisms, Biologics may include, but is not limited to, vaccines, blood, blood components, cells, allergens, genes, tissues, and recombinant proteins. The OT container 10 may combine high performance thermal insulation layer materials with temperature controlling chemical reactions to provide a pouch that maintains its contents at precise temperatures. The OT container 10 may include a barrier film, an active temperature control element, and a thermal insulation layer material. In one form factor, OT container 10 can be deployed as a flexible pouch for distributing blood products inside a hospital.

Figure 13:
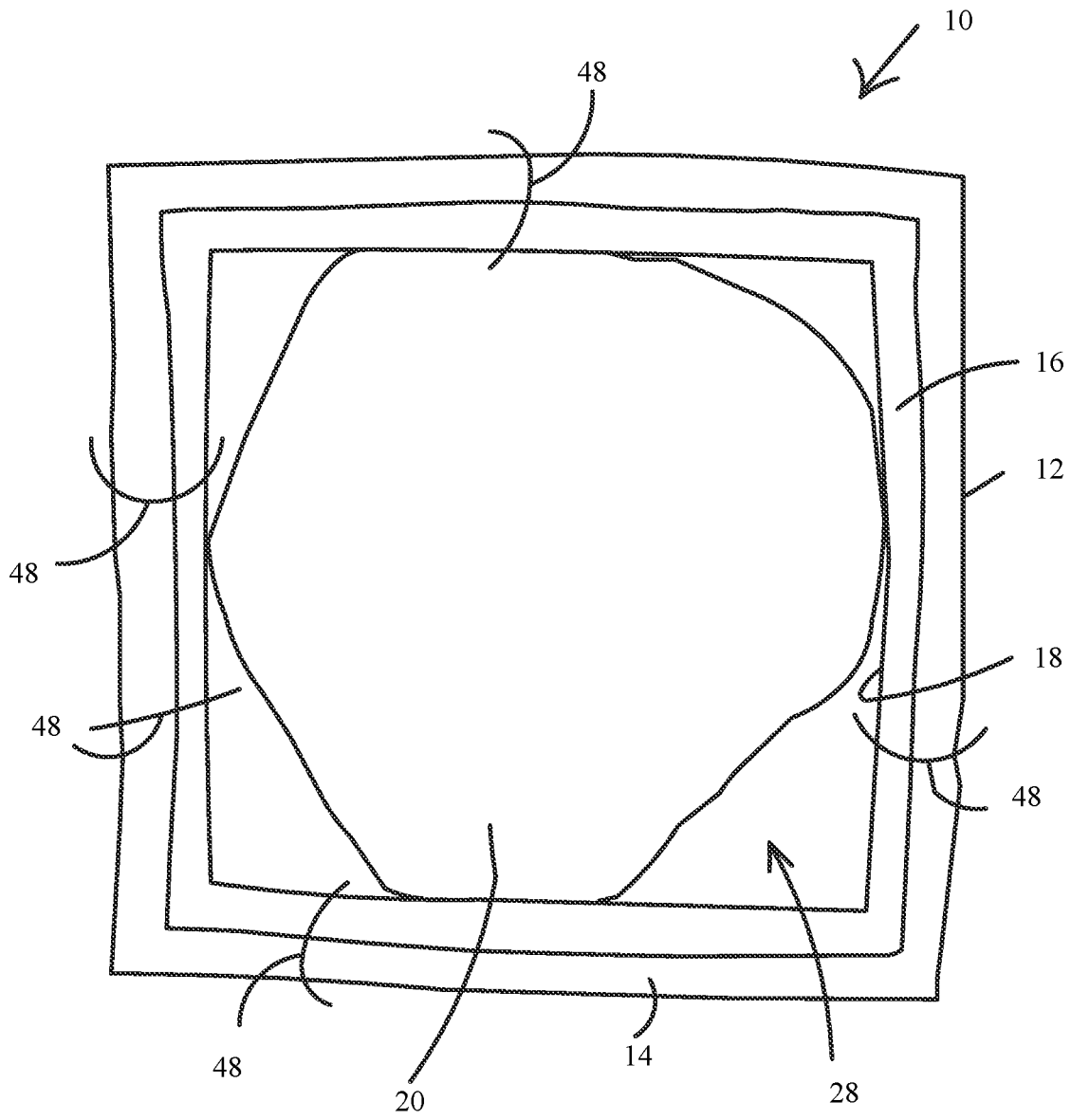
FIG. 13 shows a plan view of an on-demand thermoregulation container.

FIG. 13 shows a plan view of an OT container 10. The OT container 10 may be substantially square, as opposed to a pouch shown in some earlier embodiments. In this embodiment of the OT container 10 is substantially square, and the OT container 10 has the wall 48 that may include the outer skin barrier layer 12, external thermal insulation layer 50, the thermoregulation layer 14, the thermal insulation layer 16, and the inner skin barrier layer 18. A bottom of the storage volume 28 may also include the wall 48 so that all the surfaces of the payload 20 may be surrounded by the wall 48 structure to provide thermoregulation.

Figure 14:
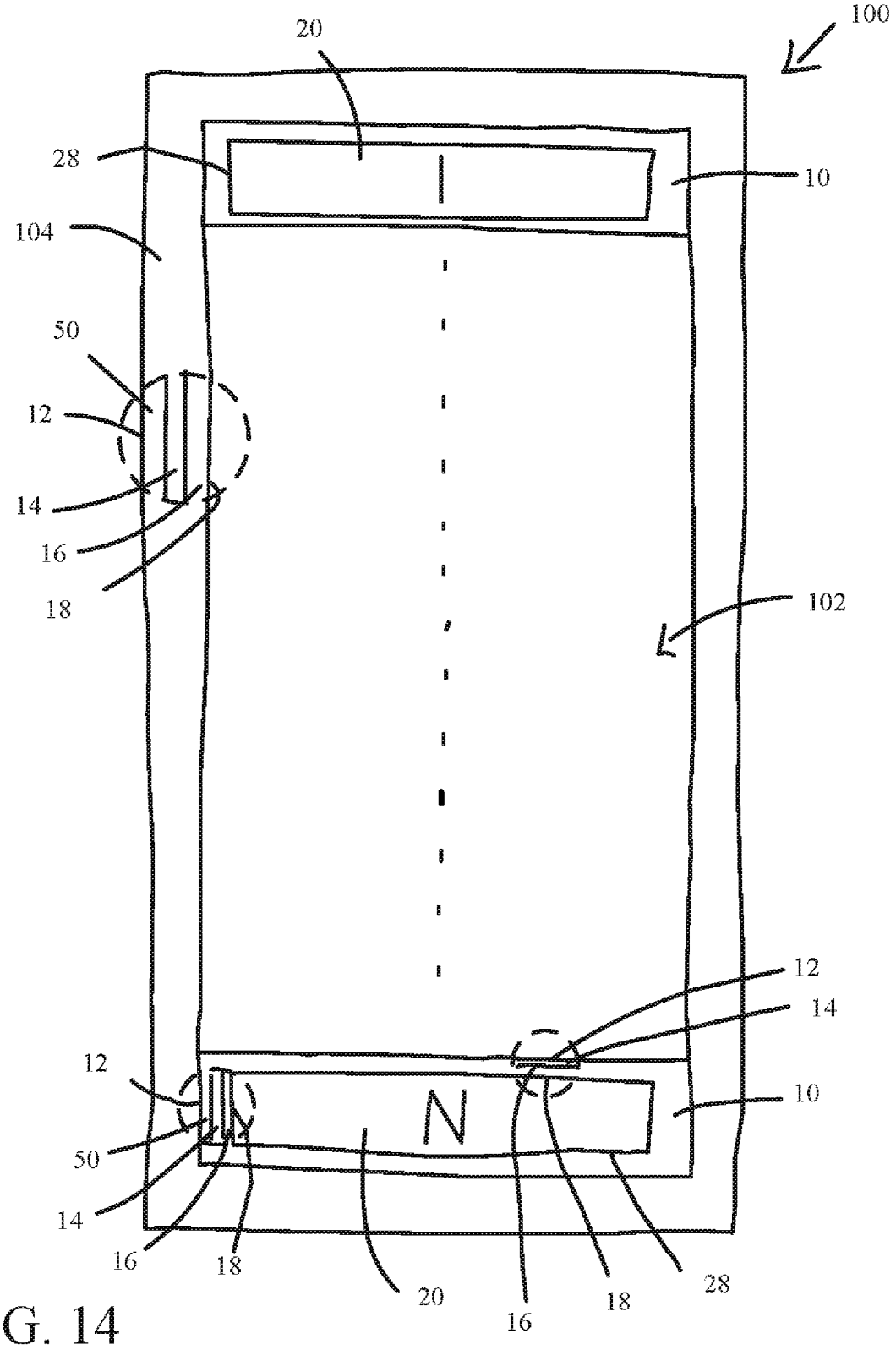
FIG. 14 shows a plan view of N on-demand thermoregulation containers inside another container.
Figure 15:
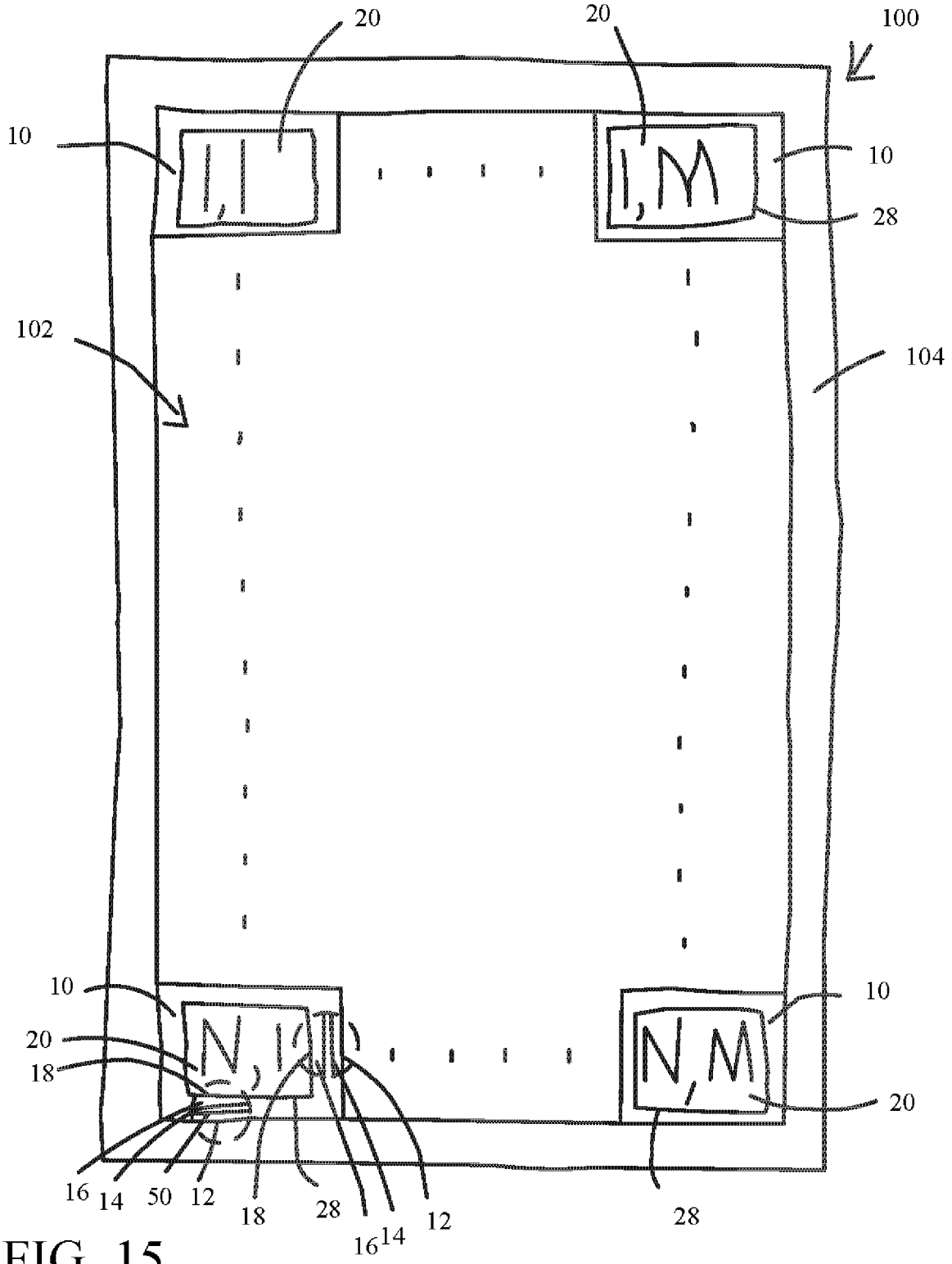
FIG. 15 shows a plan view of N by M on-demand thermoregulation containers in another container.

FIGS. 14-15 show plan views of an OT system 100 with a system storage volume 102 surrounded by a wall 104. In the OT system 100, multiple of the OT container 10 may be used together. As shown by way of example and not limitation, the OT system 100 may be substantially rectangular. Each of the multiple of the OT container 10 may be of substantially the same size. Of course, the OT system 100 may take any suitable size and shape, such as the various shapes discussed hereinabove for the OT container 10 and shown in FIGS. 7A-7G.

The system storage volume 102 of the OT system 100 may be configured to contain from 1 to N of the OT container 10, wherein the N is a whole number of 2 or more. Each of the OT container 10 may have the storage volume 28 to contain a different individual temperature sensitive material, i.e., the payload 20. Therefore, the OT system 100 with N of the OT container 10, may contain N of the payload 20. The system storage volume 102 may be considered to have an aggregate of storage volume equal to the storage volume 28 of all the OT container 10 on the OT system 100.

The wall 104 of the OT system 100 may have a similar construction of the OT container 10, such that the wall 104 may include the outer skin barrier layer 12, external thermal insulation layer 50, the thermoregulation layer 14, the thermal insulation layer 16, and the inner skin barrier layer 18. In other words, the OT system 100 may be considered to have N of the OT container 10 contained in a larger version of the OT container 10. Alternatively, the wall 104 may have another construction, such as a consumer grade cooler, Styrofoam® container, etc.

With N of the OT container 10 in the system storage volume 102, the thermal properties of N of the OT container 10 may cooperate to support each other in obtaining the desired temperature or the desired temperature range. In other words, each of N of the OT container 10 may have a thermoregulation layer 14. Each of N of the OT container 10 in the system storage volume 102 may contribute to an internal ambient environmental temperature of the system storage volume 102 that is experienced by the storage volume 28 of each of N of the OT container 10. The cooperation of N of the OT container 10 may be experienced more efficiently when the external thermal insulation layer 50 is not present in N of the OT container 10. As discussed earlier, the external thermal insulation layer 50, when present, may be located between the thermoregulation layer 14 and the outer skin barrier layer 12. When the external thermal insulation layer 50 is not present, each of N of the OT container 10 may be more readily exposed to the internal ambient environmental temperature of the system storage volume 102 that is produced from the chemical reaction of each N of the thermoregulation layer 14 that is activated in the system storage volume 102. The internal ambient environmental temperature, and therefore each N of the storage volume 28, may stay at the desired temperature or the desired temperature range for an increased duration than would be achieved by one of the storage volume 28 with activation of the thermoregulation layer 14 in one of the OT container 10.

Furthermore, the external thermal insulation layer 50 might be present on an exterior surface of the OT container 10 as shown on the OT container 10 labeled N in FIG. 14, while the external thermal insulation layer 50 might not be present on an internal surface of the OT container 10 as shown on the OT container 10 again labeled N. The exterior surface is directly between the storage volume 28 and the wall 104. On the other hand, the interior surface is between adjacent units of the OT container 10.

FIG. 15 shows a plan view of the OT system 100 with the system storage volume 102 surrounded by a wall 104 in which multiple of the OT container 10 are used together. As shown by way of example and not limitation, the OT system 100 may be substantially rectangular. In FIG. 15, the system storage volume 102 of the OT system 100 may be configured to contain from 1 to N of the OT container 10 in a first dimension, wherein the N is a whole number of 2 or more; and the system storage volume 102 of the OT system 100 may be configured to contain from 1 to M of the OT container 10 in a second dimension, wherein the M is a whole number of 2 or more. Of course, the OT system 100 may take any suitable size and shape, such as the various shapes discussed hereinabove for the OT container 10 and shown in FIGS. 7A-7G.

With N, M of the OT container 10 in the system storage volume 102, the thermal properties of N, M of the OT container 10 may cooperate to support each other in obtaining the desired temperature or the desired temperature range. In other words, each of N, M of the OT container 10 may have a thermoregulation layer 14. Each of N, M of the OT container 10 in the system storage volume 102 may contribute to an internal ambient environmental temperature of the system storage volume 102 that is experienced by the storage volume 28 of each of N, M of the OT container 10. The cooperation of N, M of the OT container 10 may be experienced more efficiently when the external thermal insulation layer 50 is not present in N, M of the OT container 10. As discussed earlier, the external thermal insulation layer 50, when present, may be located between the thermoregulation layer 14 and the outer skin barrier layer 12. When the external thermal insulation layer 50 is not present, each of N, M of the OT container 10 may be more readily exposed to the internal ambient environmental temperature of the system storage volume 102 that is produced from the chemical reaction of each N, M of the thermoregulation layer 14 that is activated in the system storage volume 102. The internal ambient environmental temperature, and therefore each N, M of the storage volume 28, may stay at the desired temperature or the desired temperature range for an increased duration than would be achieved by one of the storage volume 28 with activation of the thermoregulation layer 14 in one the OT container 10.

Furthermore, the external thermal insulation layer 50 might be present on an exterior surface of the OT container 10 as shown on the OT container 10 labeled N, 1 in FIG. 14, while the external thermal insulation layer 50 might not be present on an internal surface of the OT container 10 as shown on the OT container 10 again labeled N, 1. The exterior surface is directly between the storage volume 28 and the wall 104. On the other hand, the interior surface is between adjacent units of the OT container 10.

Figure 16:
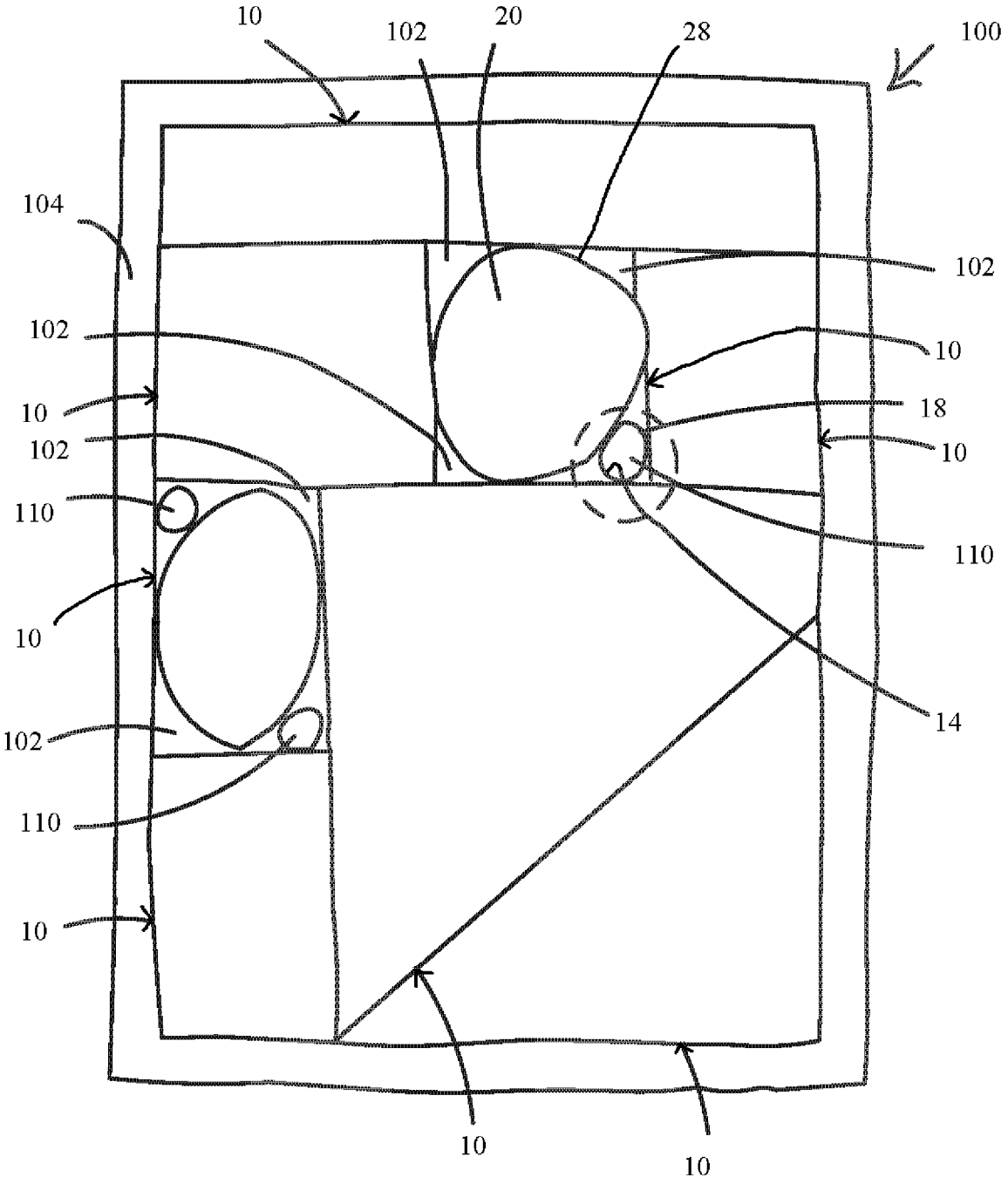
FIG. 16 shows in plan view N on-demand thermoregulation containers of varying sizes.

FIG. 16 shows a plan view of the OT system 100 with the system storage volume 102 surrounded by the wall 104. In the OT system 100, multiple of the OT container 10 may be used together. As shown by way of example and not limitation, the OT system 100 may be substantially rectangular. Of course, the OT system 100 may take any suitable size and shape, such as the various shapes discussed hereinabove for the OT container 10 and shown in FIGS. 7A-7G. Furthermore, each of the OT container 10 in the system storage volume 102 may any suitable size and shape responsive to the size and shape of the payload. In other words, each of the multiple of the OT container 10 may not be of substantially the same size and shape, or may be considered to be of substantially different size and shape.

Figure 17:
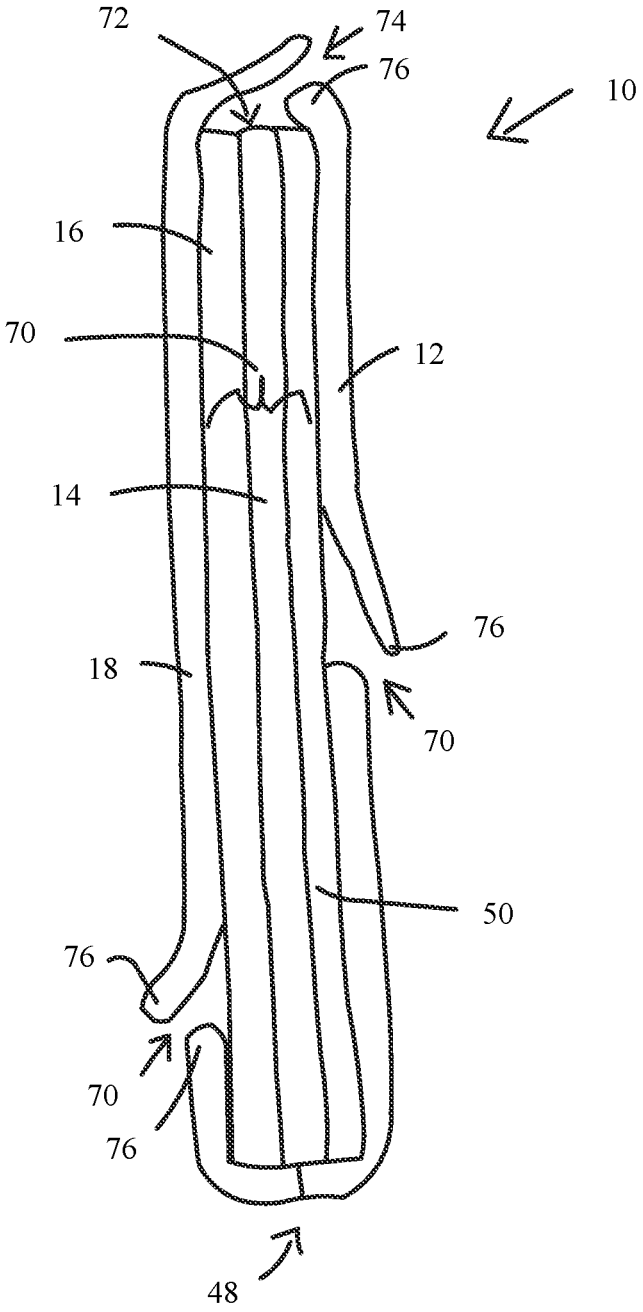
FIG. 17 shows a cross section of the wall of the on-demand thermoregulation container.

Furthermore, one or more of an OT system 110 may be present in the system storage volume 102. The OT system 110 may include the inner skin barrier layer 18 that surrounds the thermoregulation layer 14. The thermal insulation layer 16 may not be present between the inner skin barrier layer 18 that surrounds the thermoregulation layer 14. The thermal insulation layer 16 is optional, and the thermal insulation layer 16 is not shown for clarity in the FIG. after being shown in so many other FIGS. of the present disclosure. The thermal insulation layer 16 is optional in the OT system 110, because the OT system 110 does not have the storage volume 28 for the payload 20 as with the OT container 10. So, the thermal insulation layer 16 may not be needed to protect the payload from temperature spikes after activation of the chemical reaction. Other words, the OT system 110 may act as filler in the system storage volume 102 that provides further thermoregulation capacity to the OT system 110. FIG. 17 shows a cross section of the wall 48 of the OT container 10. The thermoregulation layer 14, thermal insulation layer 16, and the external thermal insulation layer 50 (when the external thermal insulation layer 50 is present) may be considered a thermoregulation element 70. The thermoregulation element 70 may be housed in a thermoregulation volume 72. The thermoregulation element 70 may be removed through a portal 74 that is in an open configuration in the wall 48 of the OT container 10. The thermoregulation layer 14 may be removed through the portal 74 that is in an open configuration in the wall 48 of the OT container 10. The thermal insulation layer 16 may be removed through the portal 74 that is in an open configuration in the wall 48 of the OT container 10. The external thermal insulation layer 50 may be removed through the portal 74 that is in an open configuration in the wall 48 of the OT container 10.

The portal 74 may be in the outer skin barrier layer 12, in the inner skin barrier layer 18, or between the outer skin barrier layer 12 and the inner skin barrier layer 18, as shown in the three examples of the portal 74 in FIG. 17. Typically, one of the portal 74 will be present, but more than one of the portal 74 is contemplated. Of course, the portal 74 may be in some combination of the outer skin barrier layer 12, in the inner skin barrier layer 18, and between the outer skin barrier layer 12 and the inner skin barrier layer 18.

The portal 74 may be in a closed configuration through use of a portal fastener 76. In the closed configuration of the portal 74, the thermoregulation volume 72 may be considered closed to the ambient environmental temperature as if the portal 74 did not exist.

Figure 18:
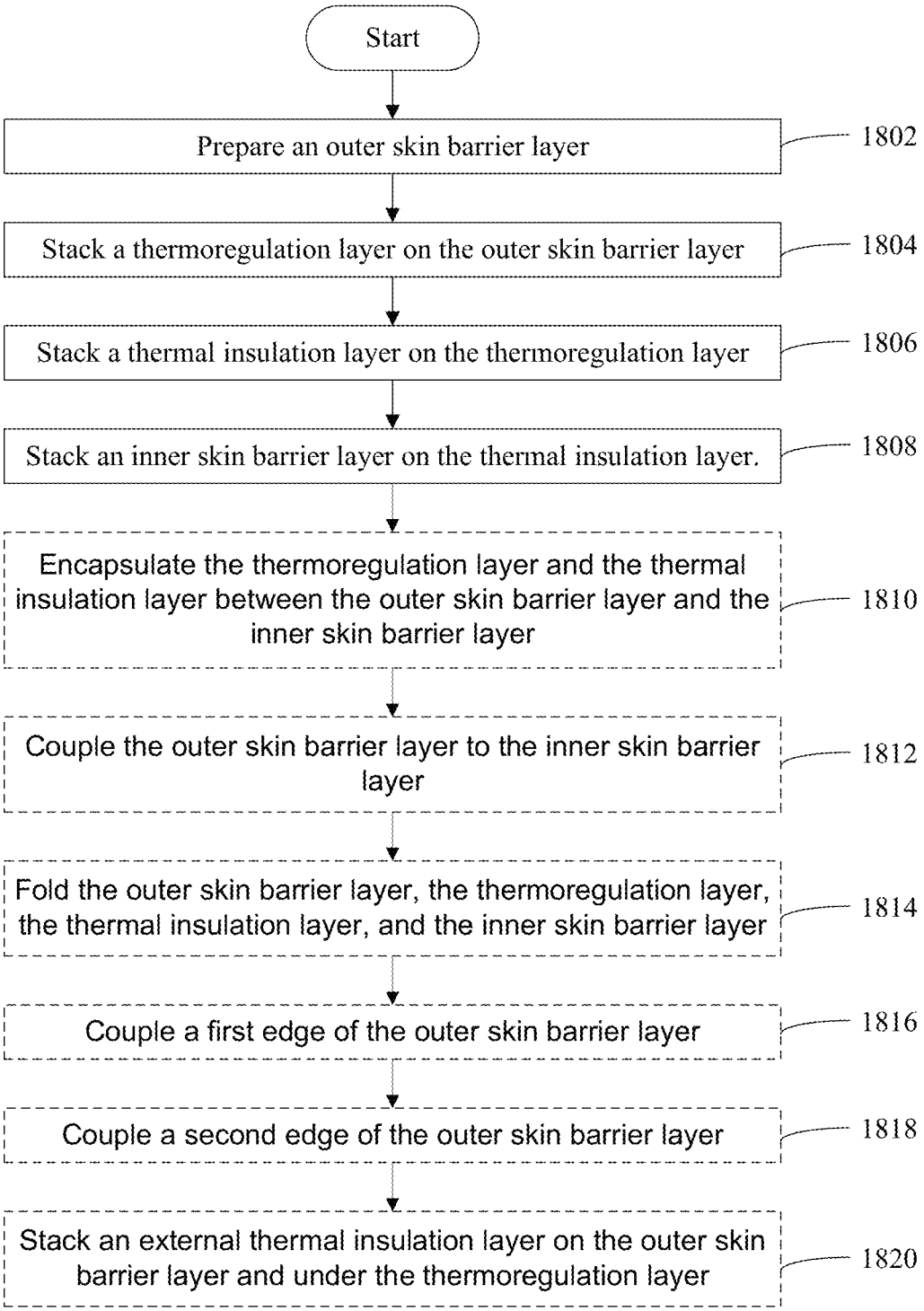
FIG. 18 shows steps for making an insulated container.

FIG. 18 shows the steps making an insulated container (1800) may include, but are not limited to:

(1802) Prepare preparing an outer skin barrier layer.

(1804) Stack a thermoregulation layer on the outer skin barrier layer, wherein the thermoregulation layer is configured for a chemical reaction for a desired temperature that is predetermined.

(1806) Stack a thermal insulation layer on the thermoregulation layer, wherein the thermal insulation layer is configured so that a payload only experiences the desired temperature from the chemical reaction.

(1808) Stack an inner skin barrier layer on the thermal insulation layer.

(1810) Encapsulate the thermoregulation layer and the thermal insulation layer between the outer skin barrier layer and the inner skin barrier layer.

(1812) Couple the outer skin barrier layer to the inner skin barrier layer.

(1814) Fold the outer skin barrier layer, the thermoregulation layer, the thermal insulation layer, and the inner skin barrier layer to form a storage volume surrounded by the inner skin barrier layer, wherein the storage volume is configured to store the payload.

(1816) Couple a first edge of the outer skin barrier layer.

(1818) Couple a second edge of the outer skin barrier layer.

(1820) Wherein the thermal insulation layer is characterized as an internal thermal insulation layer, stack an external thermal insulation layer on the outer skin barrier layer and under the thermoregulation layer, wherein the external thermal insulation layer is configured to protect an end user from the chemical reaction.

Fewer or more steps may be used in making the insulated container. The order of the steps may be varied.

While single use, or disposable, versions of the OT container 10 are disclosed and contemplated, reusable versions of the OT container 10 are also disclosed and contemplated. Depending on the economics of manufacture and use for the OT container 10, it may be useful to remove the thermoregulation layer 14, thermal insulation layer 16, or the external thermal insulation layer 50 or some combination in the OT container 10 that has been used by an end user. For example, the end user may clean the OT container 10, then the end user may remove the thermoregulation layer 14 that is first used from the OT container 10 through the portal 74 in the outer skin barrier layer 12 and insert the thermoregulation layer that will be second used through the portal 74 in the OT container 10.

It is to be understood that even though numerous characteristics and advantages of various embodiments of the present disclosure have been set forth in the foregoing description, together with details of the structure and function of various embodiments of the disclosure, this detailed description is illustrative only. Changes may be made in detail, especially in matters of structure and arrangements of parts within the principles of the present disclosure to the full extent disclosed. The person having ordinary skill in the art would contemplate using any embodiment disclosed with any other embodiment disclosed in the entire specification. The disclosure in the entire specification as understood by person having ordinary skill in the art provides the broad general meaning of the terms in which the appended claims are expressed.

The invention claimed is:

1. A container comprising:

a storage volume configured to store a payload;

a thermal insulation layer surrounding the storage volume;

a thermoregulation layer surrounding the thermal insulation layer, wherein activation of a chemical reaction in the thermoregulation layer produces an endothermic reaction or an exothermic reaction, the thermal insulation layer has R-value per inch configured to expose the payload to a desired temperature to ensure viability of the payload and dampen a temperature spike so the payload is not damaged from the activation of the chemical reaction;

a first chemical reactant in the thermoregulation layer;

a second chemical reactant in the thermoregulation layer, wherein the activation of the chemical reaction between the first chemical reactant and the second chemical reactant is configured to produce the endothermic reaction or the exothermic reaction; and a divider between the first chemical reactant and the second chemical reactant, wherein breach of the divider causes the activation of the chemical reaction.

2. The container of claim 1, wherein the payload includes a temperature sensitive biologic material that requires the desired temperature.

3. The container of claim 1, further comprising:

an outer skin barrier layer completely surrounding the thermoregulation layer; and an inner skin barrier layer completely surrounding the thermal insulation layer, wherein the outer skin barrier layer and the inner skin barrier layer are coupled to encapsulate the thermoregulation layer and the thermal insulation layer in a thermoregulation volume, and the inner skin barrier layer lines the storage volume.

4. The container of claim 3, wherein the thermoregulation layer is characterized as a first thermoregulation layer, further comprising:

a portal configured for an end user to remove the first thermoregulation layer from the thermoregulation volume and insert a second thermoregulation layer into the thermoregulation volume.

5. The container of claim 4, wherein the portal is the outer skin barrier layer, in the inner skin barrier layer, or between the outer skin barrier layer and the inner skin barrier layer, or some combination of in the outer skin barrier layer, in the inner skin barrier layer, and between the outer skin barrier layer and the inner skin barrier layer.

6. The container of claim 3, wherein the thermal insulation layer is characterized as an internal thermal insulation layer, further comprising:

an external thermal insulation layer between the outer skin barrier layer and the thermoregulation layer, wherein the external thermal insulation layer is configured to protect an end user from the chemical reaction in the thermoregulation layer.

7. The container of claim 3, further comprising:

a sealing member in an open configuration configured so that the payload may be placed in the storage volume; and a fastener configured to fasten the sealing member in a closed configuration to seal the payload in the storage volume.

8. A system of containers comprising:

a system storage volume;

N containers in the system storage volume, wherein N is a whole number of 2 or more, and each of the N containers includes:

a storage volume configured to contain a payload;

a thermoregulation layer surrounding the storage volume in the N containers, wherein activation of a chemical reaction is configured to produce an endothermic reaction or an exothermic reaction;

a thermal insulation layer surrounding the storage volume of the N containers, wherein the thermal insulation layer is configured to expose the payload to a desired temperature and dampen a temperature spike so the payload is not damaged from the activation of the chemical reaction;

a first chemical reactant in the thermoregulation layer;

a second chemical reactant in the thermoregulation layer, wherein the activation of the chemical reaction between the first chemical reactant and the second chemical reactant is configured to produce the endothermic reaction or the exothermic reaction; and a divider between the first chemical reactant and the second chemical reactant, wherein breach of the divider causes the activation of the chemical reaction.

9. The system of containers of claim 8, wherein the payload includes a temperature sensitive biologic material that requires the desired temperature.

10. The system of containers of claim 8, wherein each of the N containers are of substantially same size and shape.

11. The system of containers of claim 10, wherein at least one of the N containers is of substantially different size and shape from other N containers.

12. The system of containers of claim 8, wherein at least one of the N containers is configured to be removed from the system storage volume while others of the N containers remain in the system storage volume without damage to the N containers.

13. The system of containers of claim 8, wherein the thermoregulation layer surrounding the storage volume in the N containers, further comprising:

the first chemical reactant in at least one of the thermoregulation layer surrounding the storage volume in the N containers; and the second chemical reactant in the at least one of the thermoregulation layer surrounding the storage volume in the N containers, wherein the activation of the chemical reaction between the first chemical reactant and the second chemical reactant is configured to produce the endothermic reaction or the exothermic reaction.

14. The system of containers of claim 8, further comprising:

a system thermal insulation layer surrounding the storage volume; and a system thermoregulation layer surrounding the system thermal insulation layer, wherein the system thermoregulation layer is configured for a system chemical reaction that is predetermined, and the system thermal insulation layer is configured for the payload to experience the desired temperature and to dampen the temperature spike from the system chemical reaction.

15. A method of making an insulated container comprising:

preparing an outer skin barrier layer;

preparing a thermoregulation layer with a first chemical reactant in the thermoregulation layer, a second chemical reactant in the thermoregulation layer, wherein the activation of the chemical reaction between the first chemical reactant and the second chemical reactant is configured to produce the endothermic reaction or the exothermic reaction; and a divider between the first chemical reactant and the second chemical reactant, wherein breach of the divider causes the activation of the chemical reaction;

stacking the thermoregulation layer on the outer skin barrier layer, wherein the thermoregulation layer is configured for a chemical reaction for a desired temperature that is predetermined;

stacking a thermal insulation layer on the thermoregulation layer, wherein the thermal insulation layer is configured so that a payload only experiences the desired temperature from the chemical reaction; and stacking an inner skin barrier layer on the thermal insulation layer.

16. The method of making the insulated container of claim 15, further comprising:

encapsulating the thermoregulation layer and the thermal insulation layer between the outer skin barrier layer and the inner skin barrier layer; and coupling the outer skin barrier layer to the inner skin barrier layer.

17. The method of making the insulated container of claim 16, further comprising:

folding the outer skin barrier layer, the thermoregulation layer, the thermal insulation layer, and the inner skin barrier layer to form a storage volume surrounded by the inner skin barrier layer, wherein the storage volume is configured to store the payload;

coupling a first edge of the outer skin barrier layer; and coupling a second edge of the outer skin barrier layer.

18. The method of making the insulated container of claim 17, wherein the thermal insulation layer is characterized as an internal thermal insulation layer, further comprising:

stacking an external thermal insulation layer on the outer skin barrier layer and under the thermoregulation layer, wherein the external thermal insulation layer is configured to protect an end user from the chemical reaction.

* * * * *